US010113348B2

(12) United States Patent
Lam

(10) Patent No.: US 10,113,348 B2
(45) Date of Patent: Oct. 30, 2018

(54) MAGNETIC LEVITATING DOOR

(71) Applicant: Tony Lam, Costa Mesa, CA (US)

(72) Inventor: Tony Lam, Costa Mesa, CA (US)

( * ) Notice: Subject to any disclaimer, the term of this patent is extended or adjusted under 35 U.S.C. 154(b) by 0 days.

(21) Appl. No.: 15/723,045

(22) Filed: Oct. 2, 2017

(65) Prior Publication Data

US 2018/0148965 A1 May 31, 2018

Related U.S. Application Data

(60) Provisional application No. 62/525,118, filed on Jun. 26, 2017, provisional application No. 62/427,024, filed on Nov. 28, 2016.

(51) Int. Cl.

| | |
|---|---|
| ***E05D 15/06*** | (2006.01) |
| ***E06B 3/46*** | (2006.01) |
| ***A47K 3/34*** | (2006.01) |

(52) U.S. Cl.

CPC ..... *E05D 15/0691* (2013.01); *A47K 3/34* (2013.01); *E05D 15/0656* (2013.01); *E06B 3/4681* (2013.01); *E05D 2015/0695* (2013.01); *E05Y 2900/114* (2013.01)

(58) Field of Classification Search

CPC ..... E05D 2015/0695; E05D 15/0691
See application file for complete search history.

(56) References Cited

U.S. PATENT DOCUMENTS 3,334,442 A * 8/1967 Boettcher ..... E05D 15/0621 16/87 R
3,346,993 A * 10/1967 Johnson ..... E05D 15/066 16/320
4,575,966 A * 3/1986 Gerritsen ..... E05D 15/0682 49/209
5,134,324 A * 7/1992 Sakagami ..... H02K 41/031 104/281
7,592,720 B2 9/2009 Busch
7,608,949 B2 10/2009 Busch
7,752,810 B2 * 7/2010 Haab ..... E05D 15/0621 49/404
8,020,346 B2 * 9/2011 Singiser ..... E05D 15/0682 49/360
8,707,626 B2 * 4/2014 Martin ..... E05D 15/0626 49/404
9,433,306 B2 9/2016 Rainis et al.
9,719,282 B2 * 8/2017 Bellei ..... E05D 15/565
(Continued)

FOREIGN PATENT DOCUMENTS

EP 0241063 10/1987
JP 2002220179 A * 8/2002 ..... F16C 29/02
(Continued)

OTHER PUBLICATIONS

Machine translation of JP 2002204483A.*
(Continued)

*Primary Examiner* — Marcus Menezes
(74) *Attorney, Agent, or Firm* — Stetina Brunda Garred and Brucker

(57) ABSTRACT

A magnetically levitating door is disclosed herein. The door may have a magnet that is repelled from a magnet of a track. The track may be disposed adjacent to a door opening. The track may have a stabilizing roller to maintain vertical alignment of the magnets used to levitate the door off of the track.

10 Claims, 34 Drawing Sheets

(56) References Cited

U.S. PATENT DOCUMENTS

2012/0255229 A1* 10/2012 Rosenbeck-Mortensen E05D 15/0621 49/194
2014/0016885 A1* 1/2014 Rainis ..... E05D 15/06 384/8

FOREIGN PATENT DOCUMENTS

JP 2004204483 A * 7/2004 ..... E05D 15/0626
WO WO2011142780 11/2011

OTHER PUBLICATIONS

Machine translation of JP 2002220179A.*
Floating Door System, Mondoor, Brochure, Published at least as early as Sep. 2012.
S. Zhuravlev, PCT Written Opinion of the International Searching Authority, dated Feb. 21, 2018.
S. Zhuravlev, PCT International Search Report, dated Feb. 21, 2018.

* cited by examiner

MAGNETIC LEVITATING DOOR

CROSS-REFERENCE TO RELATED APPLICATIONS

This application relates to and claims the benefit of U.S. Provisional Application No. 62/525,118, filed on Jun. 26, 2017, and U.S. Provisional Application No. 62/427,024, filed on Nov. 28, 2016, the contents of which is expressly incorporated by reference herein.

STATEMENT RE: FEDERALLY SPONSORED RESEARCH/DEVELOPMENT

Not Applicable

BACKGROUND

The various aspects and embodiments described herein relate to a mechanism for a sliding door.

A sliding door may have a track on which the door slides to traverse the door between an opened and closed position. The rolling friction between the track and the door may be excessive due to doors that are very heavy. In this instance, it may be difficult to traverse the door between the closed and opened positions. Moreover, the very heavy door may cause other failures because of the repetitive and cyclical opening and closing of the door over a long period of time.

Accordingly, there is a need in the art for improved mechanism for a sliding door.

BRIEF SUMMARY

A track that extends across the door opening and a door that magnetically engages the track are disclosed herein. The door does not physically contact the track and if the door does physically contact the track, only a small fraction of the weight of the door is transferred to the track. In this regard, the lack of physical contact between the track and the door allows the door to be traversed smoothly between the opened and closed positions and the rolling friction between the door and the track is substantially eliminated or minimized. The track and the door may have magnets that repel each other and lift the door away from the track so that the door does not contact the track. A stabilizing roller may also be utilized so that the door and the track remain aligned as the door is traverse between the opened and closed positions.

More particularly, a door assembly with a door disposable in front of a door opening and traversable between an open position and closed position is disclosed. The door assembly may comprise the door, a bracket, a first magnet, a track, a second magnet and a stabilizing roller. The door may slide to the open and closed positions. The first door may define a length. The bracket may be attached to the first door. The first magnet may be attached to the bracket. The first magnet may have a length less than the length of the first door. The track may be disposed adjacent to the door opening. The track may define a length about two times a length of the first door. The bracket may be slidably mounted to the track. The second magnet may be attached to the track. The second magnet may have a length greater than a length of the door. The first and second magnets may be vertically aligned to each other. The stabilizing roller may be attached to the track and disposed within the track for vertically aligning the first and second magnets as the door is traversed between the open and closed positions.

The bracket may comprise first and second brackets disposed on either side of a vertical midline of the door.

The second magnet may be about greater than 80% of a length of the track.

The track may be embedded into a threshold of the structure surrounding the door opening. The track may be attached to left and right posts and/or header of the door which define the door opening.

The track may comprise a base and an insert having a cavity for receiving the second magnet. The insert may be inserted into a cavity defined by the base. The base may have a cavity in which a protrusion of the insert is freely insertable, and the protrusion of the insert may be held in place in the cavity of the base with an adhesive.

The first magnet may comprise a plurality of magnets disposed on opposed sides of the door so that the door is balanced on the second magnet.

The second magnet may be a single continuous magnet or a plurality of magnets positioned end to end to suspend the door evenly as the door is traversed between the open and closed positions.

A repelling force of the first and second magnets may be equal a weight of the door. It is also contemplated that the repelling force of the first and second magnets may be less than a weight of the door.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
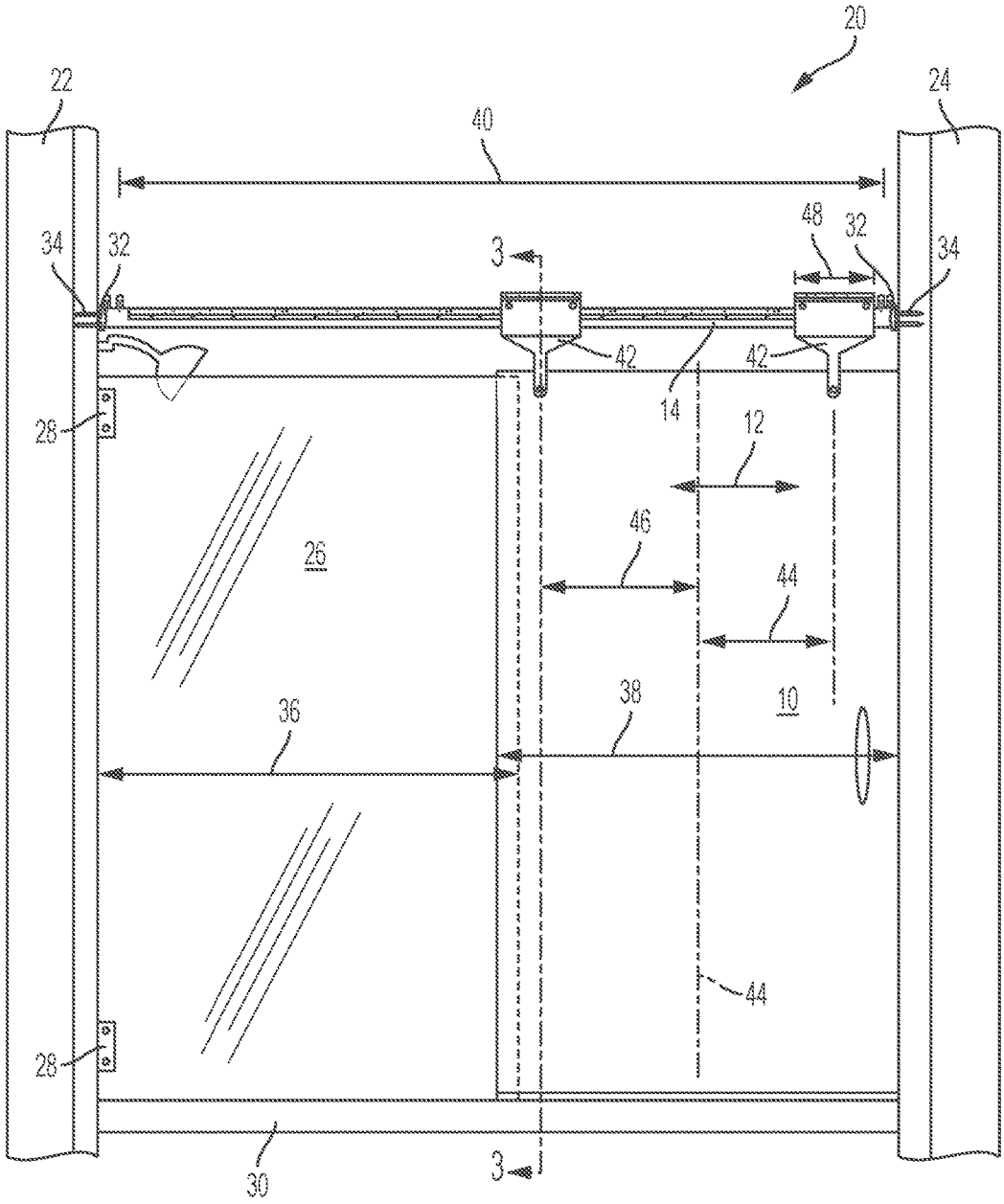
FIG. 1 is a front view of a first embodiment of a shower door.

Referring now to the drawings, a magnetically levitated shower glass door 10, 100, 200, 300, 400, 500 is shown. The glass door 10, 100, 200, 300, 400, 500, 600, 700 may be slid horizontally in the direction of arrow 12 on track 14, 114, 214, 314, 414, 514, 614, 714. The glass door 10, 100, 200, 300, 400, 500, 600, 700 may have a short magnet 16, 116, 216, 316, 416, 516, 616, 716. The track 14, 114, 214, 314, 414, 514, 614, 714 may have a long magnet 18, 118, 218, 318, 418, 518, 618, 718. The magnets 16, 116, 216, 316, 416, 516, 616, 716 may be repelled by the magnets 18, 118, 218, 218, 318, 418, 518, 618, 718 to vertically lift the glass door 10, 100, 200, 300, 400, 500, 600, 700 so that as the glass door 10, 100, 200, 300, 400, 500, 600, 700 moves horizontally in the direction of arrow 12, 112, 212, 312, 412, 512, 612, 712 and the weight of the glass door 10, 100, 200, 300, 400, 500, 600, 700 is transferred to the track 14, 114, 214, 314, 414, 514, 614, 714 through the short magnets 16, 116, 216, 316, 416, 516, 616, 716 and the long magnets 18, 118, 218, 318, 418, 518, 618, 718. A minimal amount of contact occurs between the track 14, 114, 214, 314, 414, 514, 614, 714 and the glass door 10, 100, 200, 300, 400, 500, 600, 700 so that the horizontal movement of the glass door 10, 100, 200, 300, 400, 500, 600, 700 is quiet and smooth.

Figure 2:
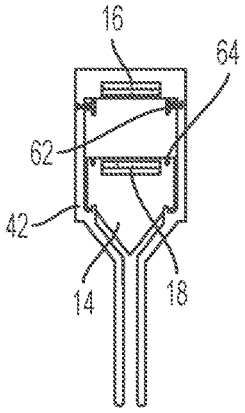
FIG. 2 is a cross-sectional view of a glass door, track and bracket of the shower door shown in FIG. 1.
Figure 3:
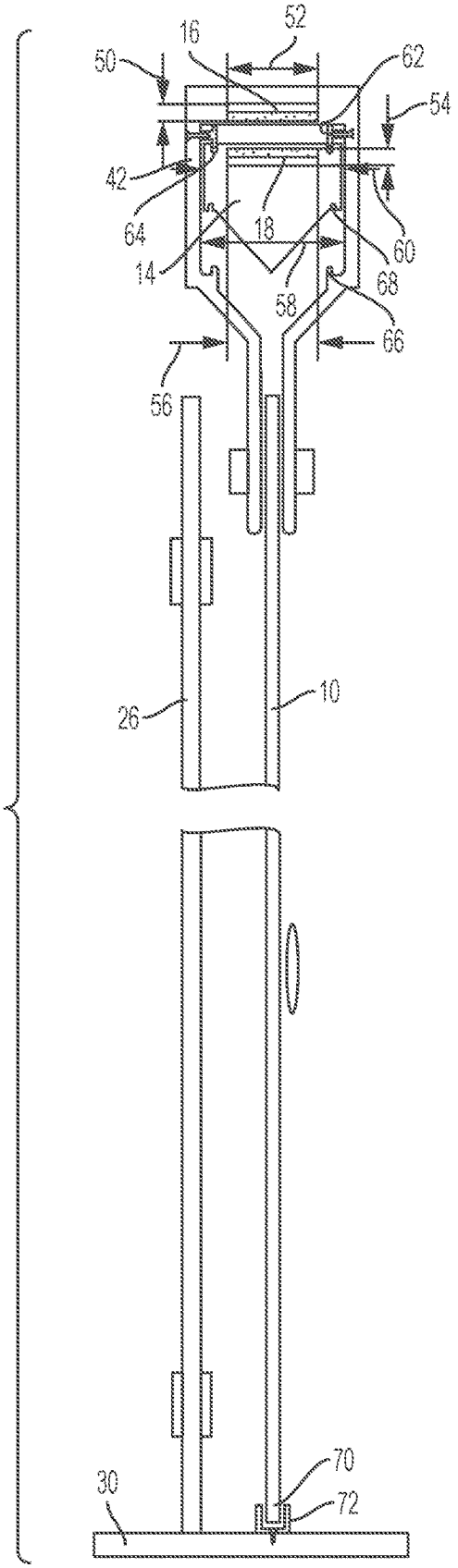
FIG. 3 is a cross-sectional view of the shower door shown in FIG. 1.

Referring now to FIGS. 1-3, a shower 20 is shown. The shower 20 has opposed first and second walls 22, 24. The shower also has a stationary glass door 26 that is secured to the first wall 22 with brackets 28. A bottom edge of the glass door 26 is also connected to a sill 30. The stationary glass door 26 is also offset from the sliding glass door 10 as shown in FIG. 3. This allows the glass door 10 to move to the left as shown in FIG. 1 and allow a person to walk through the door opening and into the shower 20. As the glass door 10 is slid to the left and the glass door 10 being magnetically lifted up, the movement of the glass door 10 is quiet and smooth.

The track 14 extends from the first wall 22 to the second wall 24 and is secured with a bracket 32 with a fastener. Referring now to FIG. 3, the track 14 may have a magnet 18 that extends along the length of the track 14. More particularly, the magnet 18 extends along the track 14 to the extent that the sliding door 10 needs to slide so that a person can enter through a door opening to enter the shower 20. In the example shown in FIG. 1, a length 36 of the stationary door 26 is about equal to a length 38 of the sliding door 10 so that the door 10 can be fully slid away. Accordingly, the length 40 of the magnet 18 is about equal to twice or slightly less than twice (e.g., 180%) the length 38 of the sliding door 10.

The sliding door 10 may be attached to at least two brackets 42. The brackets 42 position the magnet 16 above the magnet 18 to lift the door 10 upward due to the repelling force of the magnets 16, 18. Two brackets 42 are needed and are attached to the door 10 on either side of a vertical midline 44 of the door 10 which bisects the length 38 or at a center of gravity of the door 10. Preferably, the brackets 42 are placed equidistantly away from the vertical midline 44 so that each of the brackets 42 and the magnets 16 support the door 10 evenly. In this regard, a distance 44 from the midline 44 to one of the brackets 42 is equal to the distance 46 from the midline 44 to the other one of the brackets 42.

The figures and the description refer to two brackets 42. However, it is also contemplated that the two brackets 42 may be replaced with one long bracket having either two magnets 16 on both sides of the vertical midline 44 of the door 10 or one long magnet 16 that extends to both sides of the vertical midline 44 of the door 10. Preferably, the magnet 16 extends as far to the opposed sides of the door 10 as possible to provide as much balance to the door 10 as it is slid left to right. Additionally, when two magnets 16 are used, it is preferable that the magnets 16 are disposed as far away from the vertical midline 44 or center of gravity as possible. Once again, this is to provide as much balance as possible to the door 10 as it 10 is being slid left to right.

The magnets 16 of the sliding door 10 are repelled away from the magnet 18. The repelling force of the magnets 16 is sufficiently strong so that the bracket 42 does not physically contact a top of the track 14 but is vertically lifted up due to the magnetic repelling forces. Alternatively, the repelling force of the magnets 16 may be sufficiently weak so that the bracket 42 may physically contact the top of the track 14 but only a small portion of the weight of the glass door 10 is physically supported by contact of the bracket 42 on top of the track 14. That small portion may be between about 1% to 30% of the weight of the glass door 10, and is more preferably about between 1% to 10% of the weight of the glass door 10. Since there are two magnets 16, one magnet 16 for each of the brackets 42, each magnet 16 is sufficiently strong to support half of the weight of the glass door 10. As a further alternative, the repelling force of the magnets 16 may be sufficiently strong so that the bracket 42 may physically contact a bottom of the track 14 and apply about a 2 lb to 20 lb force. The prongs 66 may be replaced with rollers that ride within the grooves 68.

The repelling force of the magnet 16 to the magnet 18 may be adjusted by increasing or decreasing a length 48 (see FIG. 1), a height 50 and/or a width 52 to respectively increase or decrease the repelling force generated between the magnets 16, 18. Additionally or alternatively, the height 54 and/or the width 56 of the magnet 18 may be adjusted to respectively increase or decrease the repelling force generated between the magnets 16, 18. Any adjustment to the repelling force in the other two embodiments may also be adjusted by increasing or decreasing a length, height or width of the respective magnets and those other embodiments discussed herein.

For example, if the sliding glass door 10 weighs about 50 pounds, then each pair of magnets 16, 18 would produce a repelling force of about 25 pounds. In this way, at least a majority of the weight if not all of the weight of the sliding door 10 is supported by the repelling forces of the magnets 16.

The door 10 may have at least two brackets 42. The bracket 42 may circumscribe the track 14. An internal width 58 may be greater than an external width 60 of the track 14. This allows the bracket 14 to be horizontally traversed left and right in the direction of arrow 12. Moreover, an internal height of the bracket 42 may be greater than an external height of the track 14. The bracket 42 may have at least two rollers 62 that allow the bracket 42 to roll on the track 14. More particularly, the rollers 62 may be aligned to grooves 64 formed along a length of the track 14. The rollers 62 may engage the grooves 64 when the repelling forces created by the magnets 16, 18 are not sufficient to fully lift the door 10. Nevertheless, an insignificant amount of weight may be supported by the rollers 62 because the magnets 16, 18 may be sized to provide repelling forces that carry 80%, and more preferably 95% if not 100% of the weight of the door 10.

The bracket may have tongues 66 that are aligned to grooves 68 and support the bracket 42 when the door is not mounted to the bracket 42 and the repelling forces created by the magnets 16, 18 drive the bracket 42 upward, as shown in FIG. 2.

The bracket 42 may be fabricated from a metallic material. The brackets 42 may be mounted (i.e., slid on) on the track 14 first then the track 14 mounted to the first and second walls 22, 24. Thereafter, the glass door 10 may be mounted to the bracket 42. Alternatively, the bracket 42 may be fabricated from a plastic material and the bracket 42 slipped over the track 14 by bending the bracket 42 outward and over the track 14.

The door 10 may define a lower end portion 70 that fits within a guide 72 that extends along the entire sill 30 so that the door 10 remains vertically upright when it is slid left and right.

Figure 4:
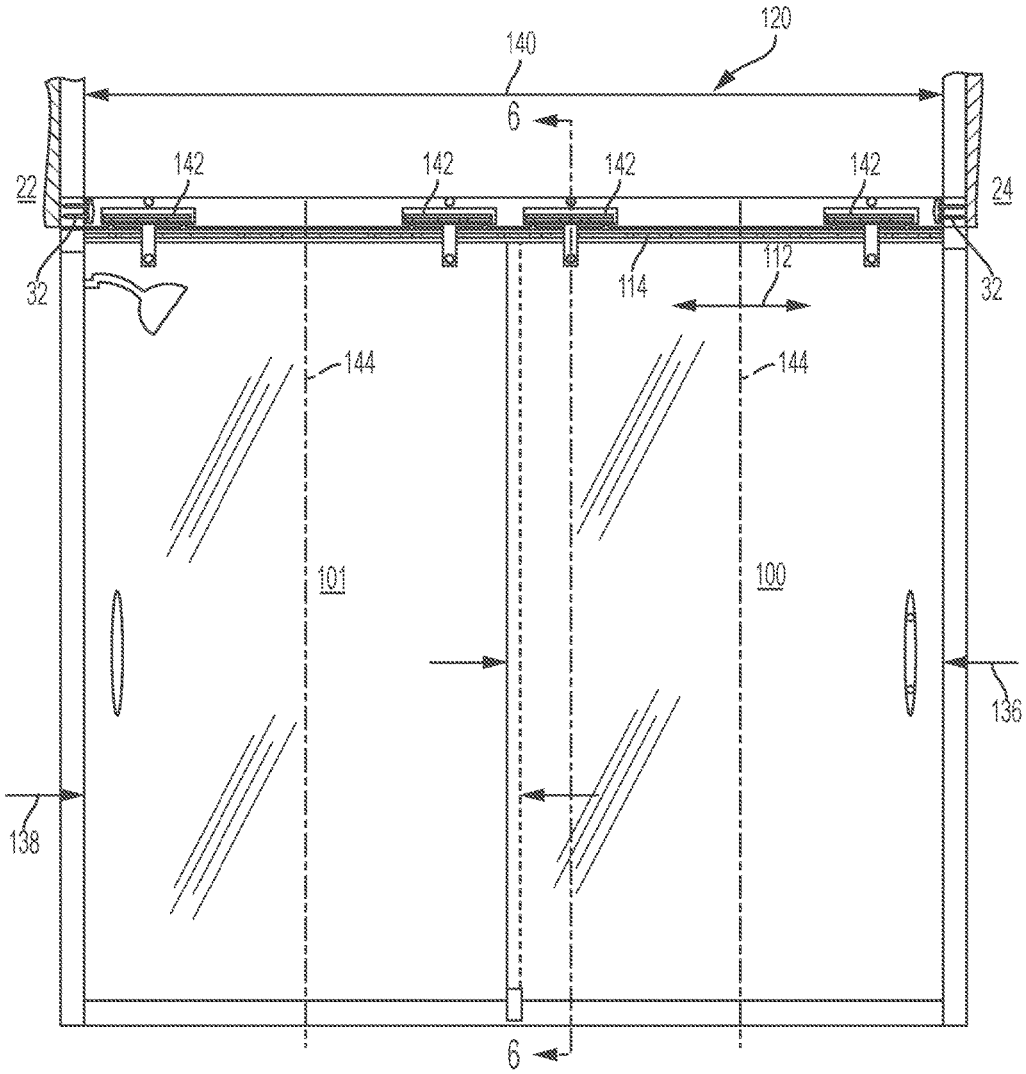
FIG. 4 is a front view of a second embodiment of the shower door.
Figure 5:
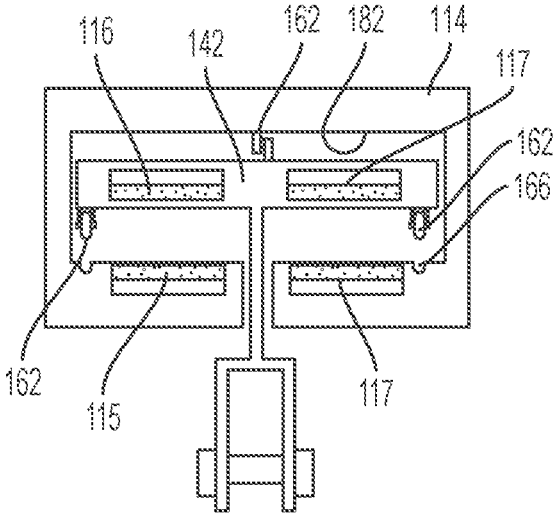
FIG. 5 is a cross-sectional view of a glass door, track and bracket of the shower door shown in FIG. 4.
Figure 6:
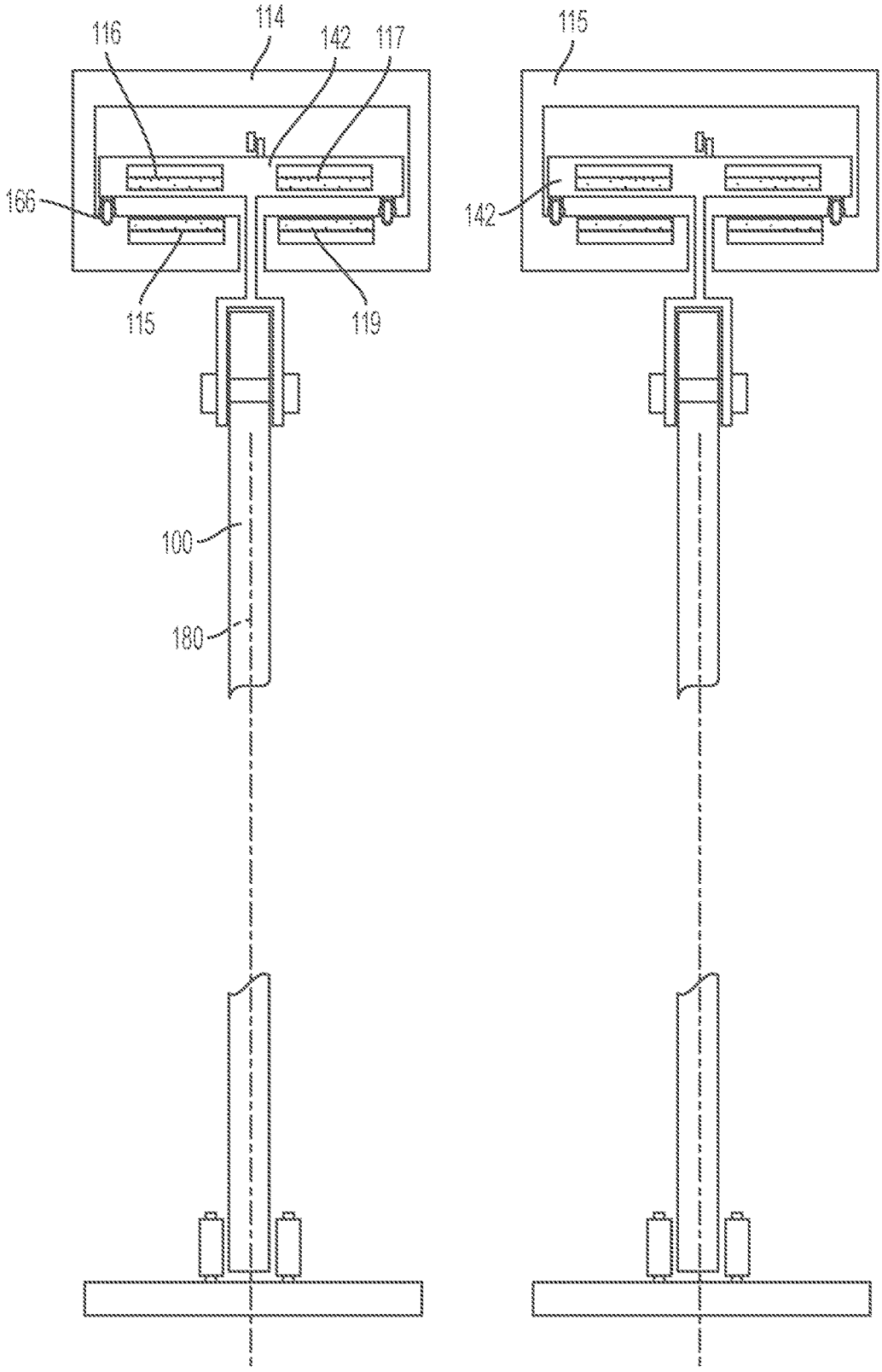
FIG. 6 is a cross-sectional view of the shower door shown in FIG. 4.

Referring now to FIGS. 4-6, a shower 120 is shown. The shower 120 has opposed first and second walls 22, 24. The shower may have the two (2) sliding glass doors 100, 101. It is also contemplated that one of the doors 100, 101 may be stationary while the other door is slidable so that a person can walk into and out of the shower 120. The glass doors 100, 101 are offset from each other, as shown in FIG. 6. Each of the glass doors 100, 101 may have brackets 142 that are slidably received into the tracks 114, 115.

The tracks 114, 115 may extend from the first wall 22 to the second wall and may be secured with a bracket and fastener 132. Referring now to FIG. 6, the tracks 114, 115 may have magnets 218, 219 that extend along the length of the tracks 114, 115. More particularly, the magnets 218, 219 may extend along the tracks 114, 115 to the extent that the sliding doors 100, 101 allow a person to enter through the door opening and into the shower 120. For example, in the shower 120 shown in FIG. 4, a length 136 of the door 100 does not necessarily have to be equal to a length 138 of the door 101. The length 140 of the magnets 218, 219 of the track 114 may be equal to about twice or slightly less than the length 136 of the sliding door 100.

The bracket 142 may have one magnet vertically aligned above a center of gravity of the door 100 or 101. Alternatively, as shown in FIG. 6, there may be two magnets 116, 117 equidistantly spaced apart from each other about a vertical plane 180 of the door 100 or 101.

The tracks 114, 115 may have corresponding magnets 115, 119. These magnets 116, 115 and magnets 117, 119 produce repelling forces that carry about 80%, more preferably 95% to 100% of the weight of the door 100 or 101. Since there are two brackets 42 for each of the doors 100, 101 and there are two magnets 116, 115 and 117, 119 for each bracket 142, each magnet 116, 117 may be designed to carry about 25% of the weight of the door 100 or 101. By way of example and not limitation, the repelling forces may be adjusted by increasing or decreasing a width, height or length of the magnets 116, 115, 117, 119.

The tracks 114, 115 may have internal grooves 166 that receive rollers 162 when the door 100, 101 is mounted to the bracket 114, 115. A majority or all of the weight may be supported by the repelling forces created by the magnets 116, 115 and the magnets 117, 119. In FIG. 6, some of the weight of the door 100, 101 is supported by the rollers 162.

Referring now to FIG. 5, when the door 100, 101 is not attached to the bracket 142, the repelling forces generated by the magnets 116, 115, 117, 119 pushes the bracket 142 and is stopped by the roller 162 which contacts a lower roof 182 of the track 114, 115.

The brackets 142 are mounted equidistantly from a vertical midline 144 of the door 100 or 101.

Figure 7:
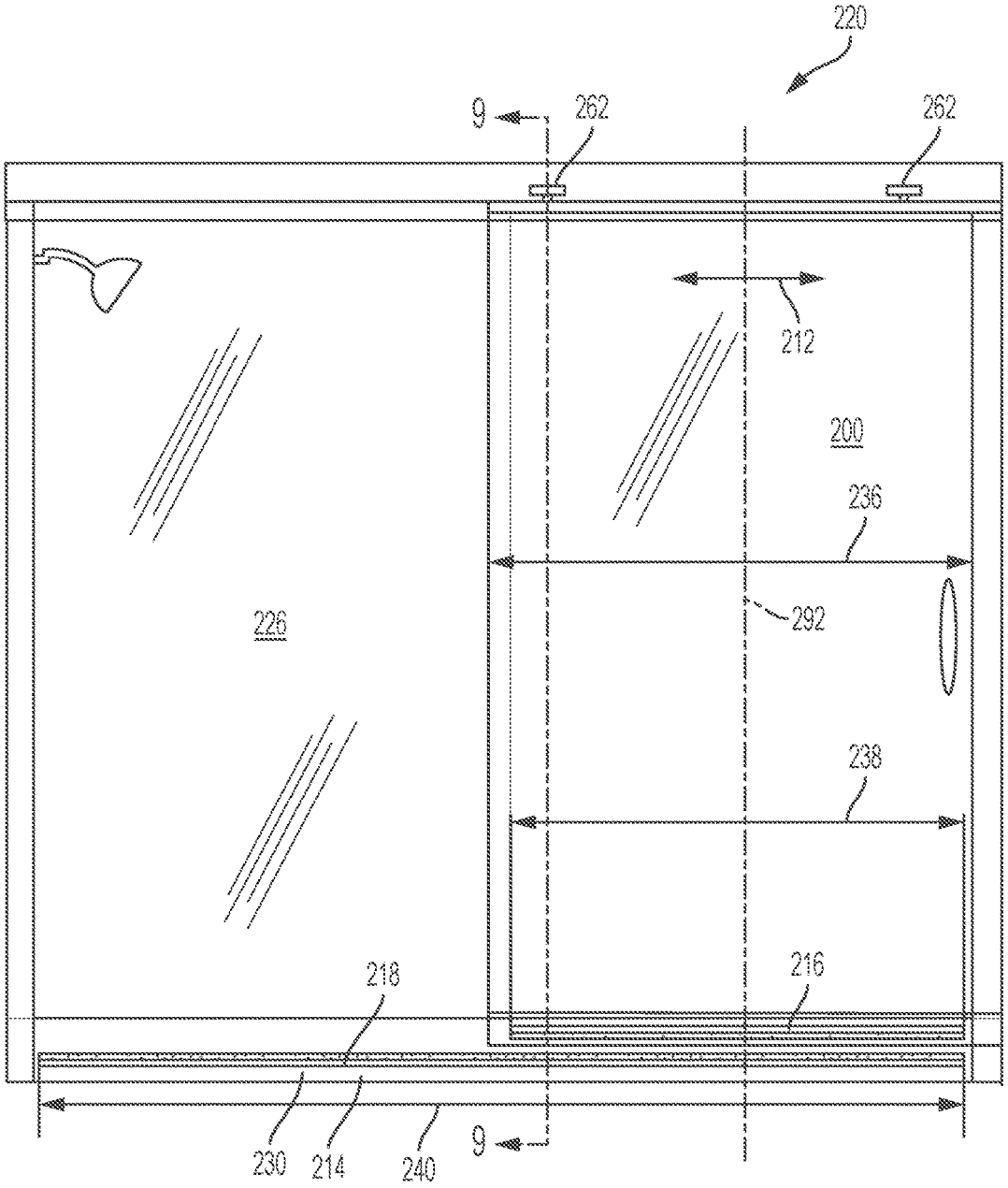
FIG. 7 is a front view of a third embodiment of the shower door.
Figure 8:
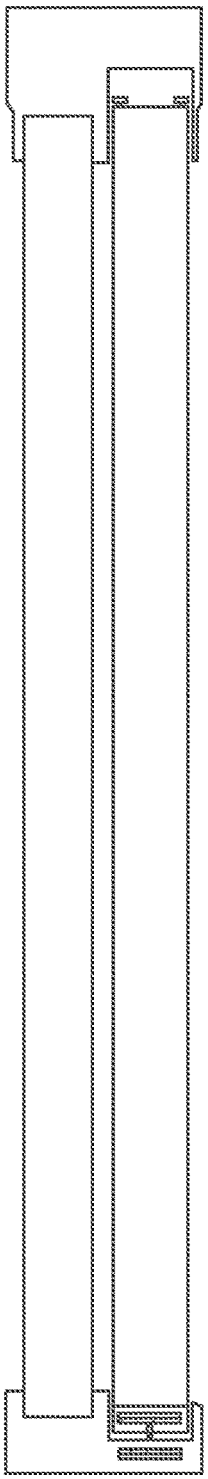
FIG. 8 is a cross-sectional view of a glass door, track and bracket of the shower door shown in FIG. 7.
Figure 9:
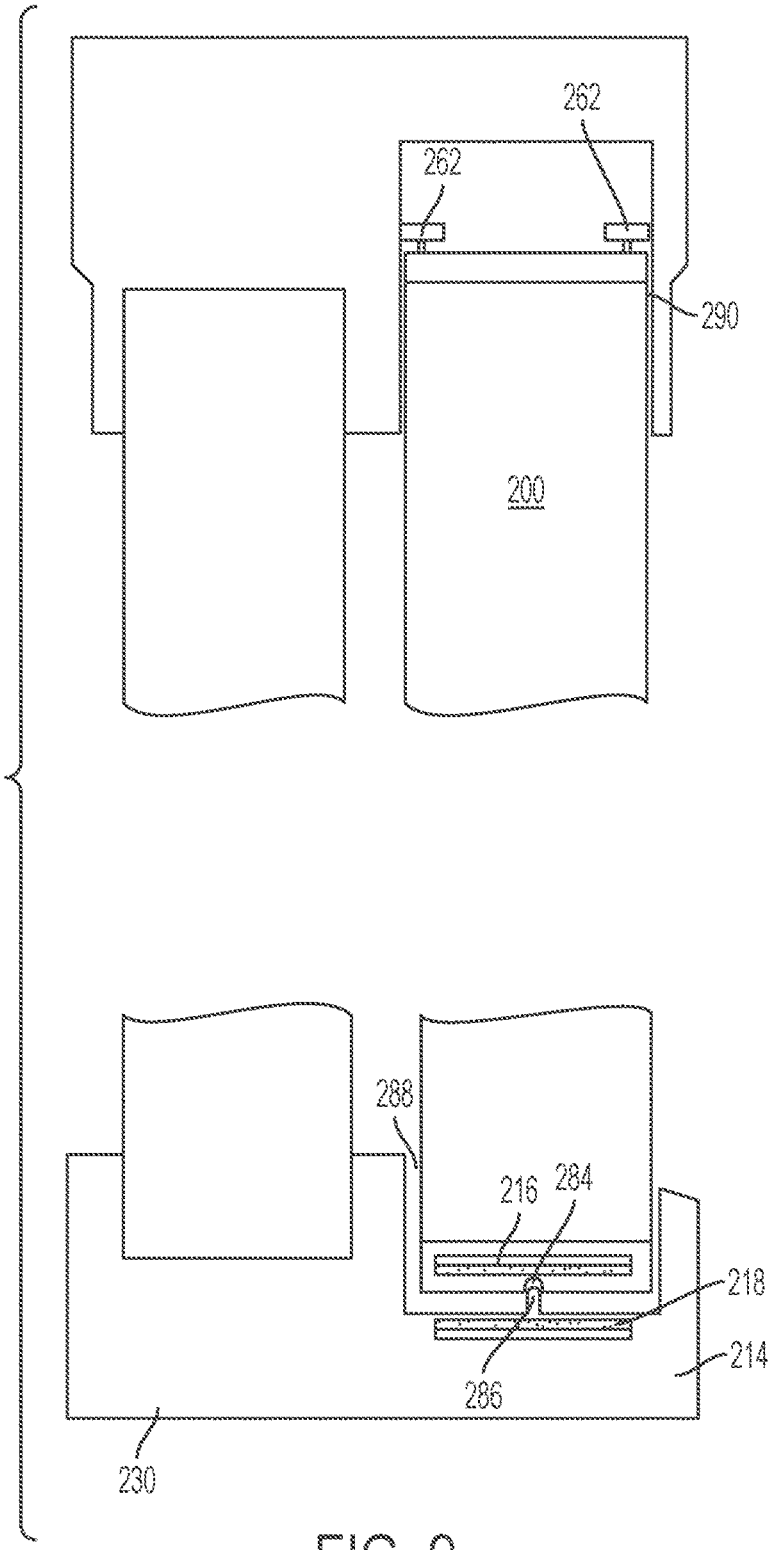
FIG. 9 is a cross-sectional view of the shower door shown in FIG. 7.
Figure 10:
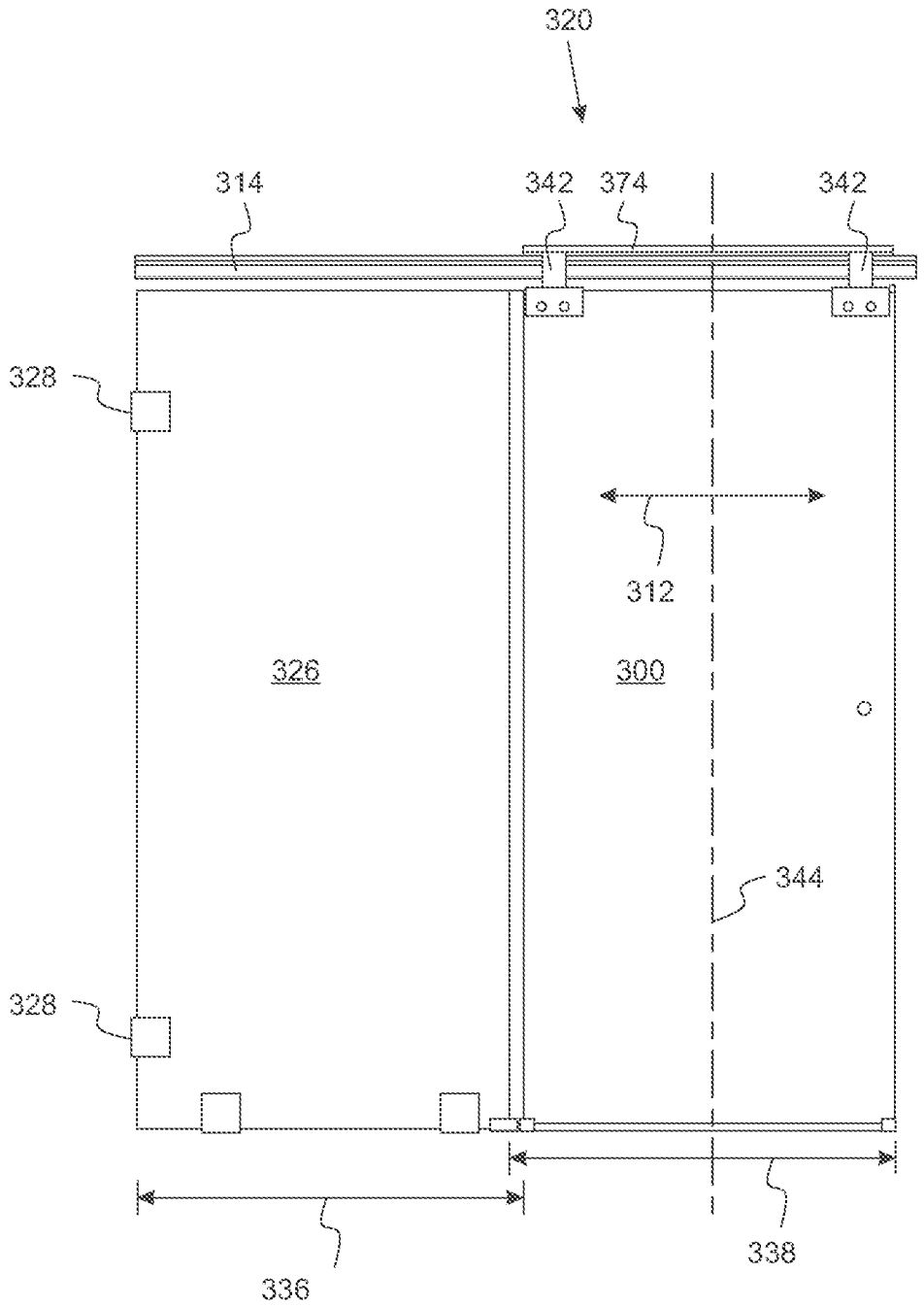
FIG. 10 is a front view of a fourth embodiment of the shower door.
Figure 11:
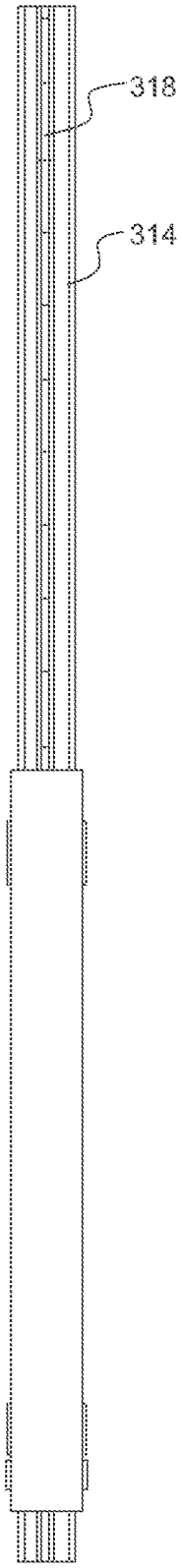
FIG. 11 is a top view of the shower door shown in FIG. 10.
Figure 12:
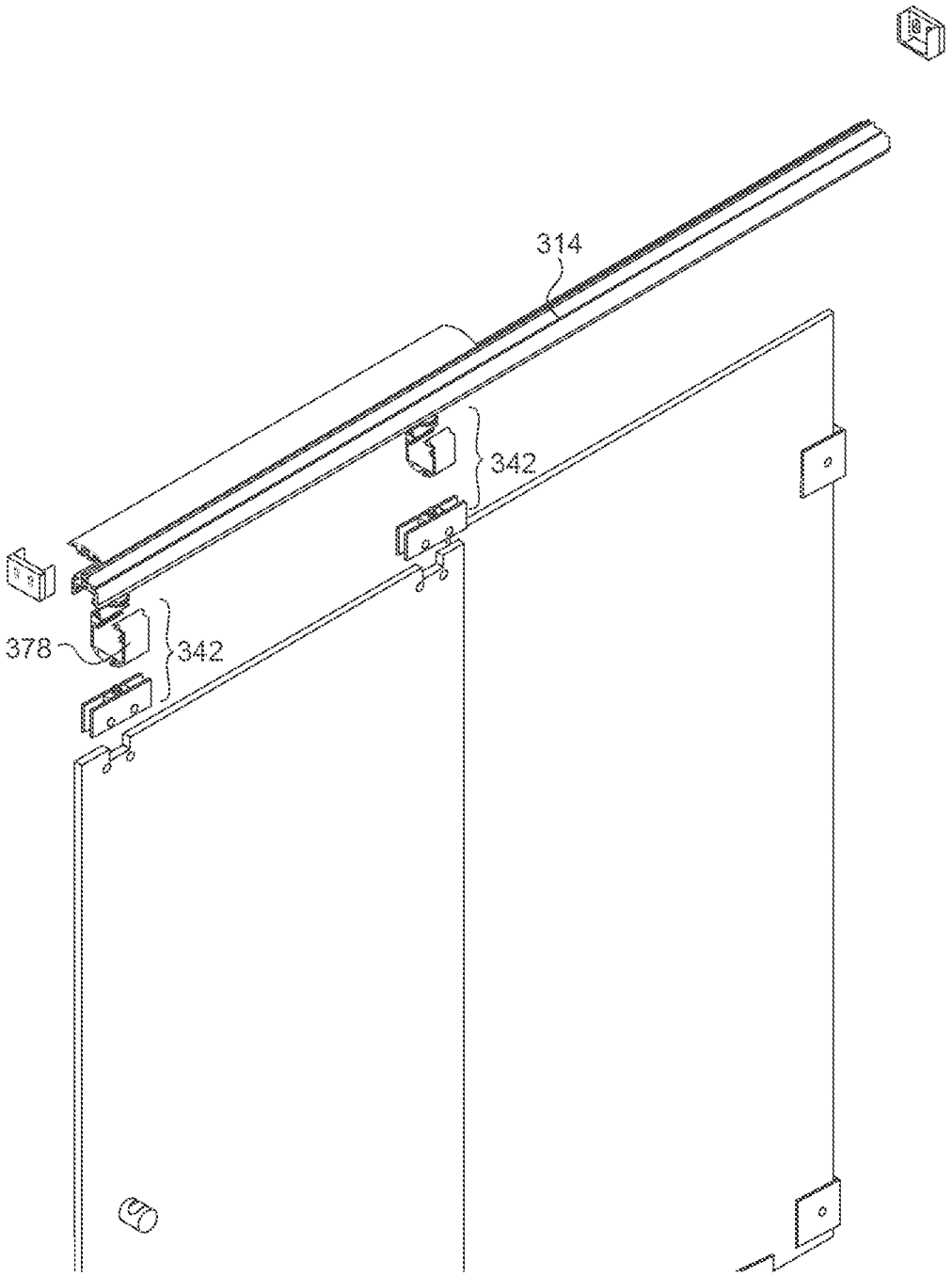
FIG. 12 is an exploded right perspective view of the shower door shown in FIG. 10.
Figure 13:
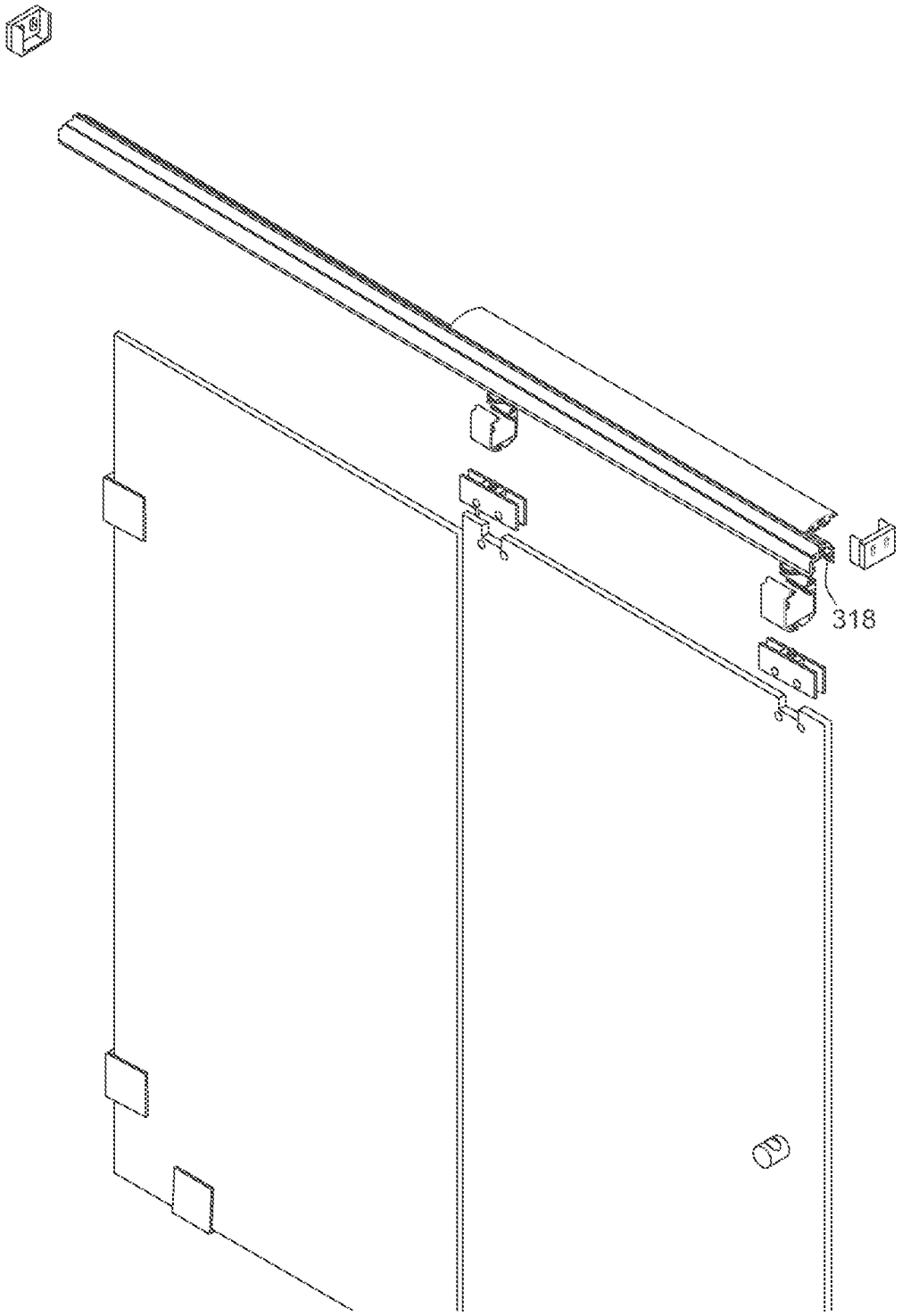
FIG. 13 is an exploded left perspective view of the shower door shown in FIG. 10.
Figure 14:
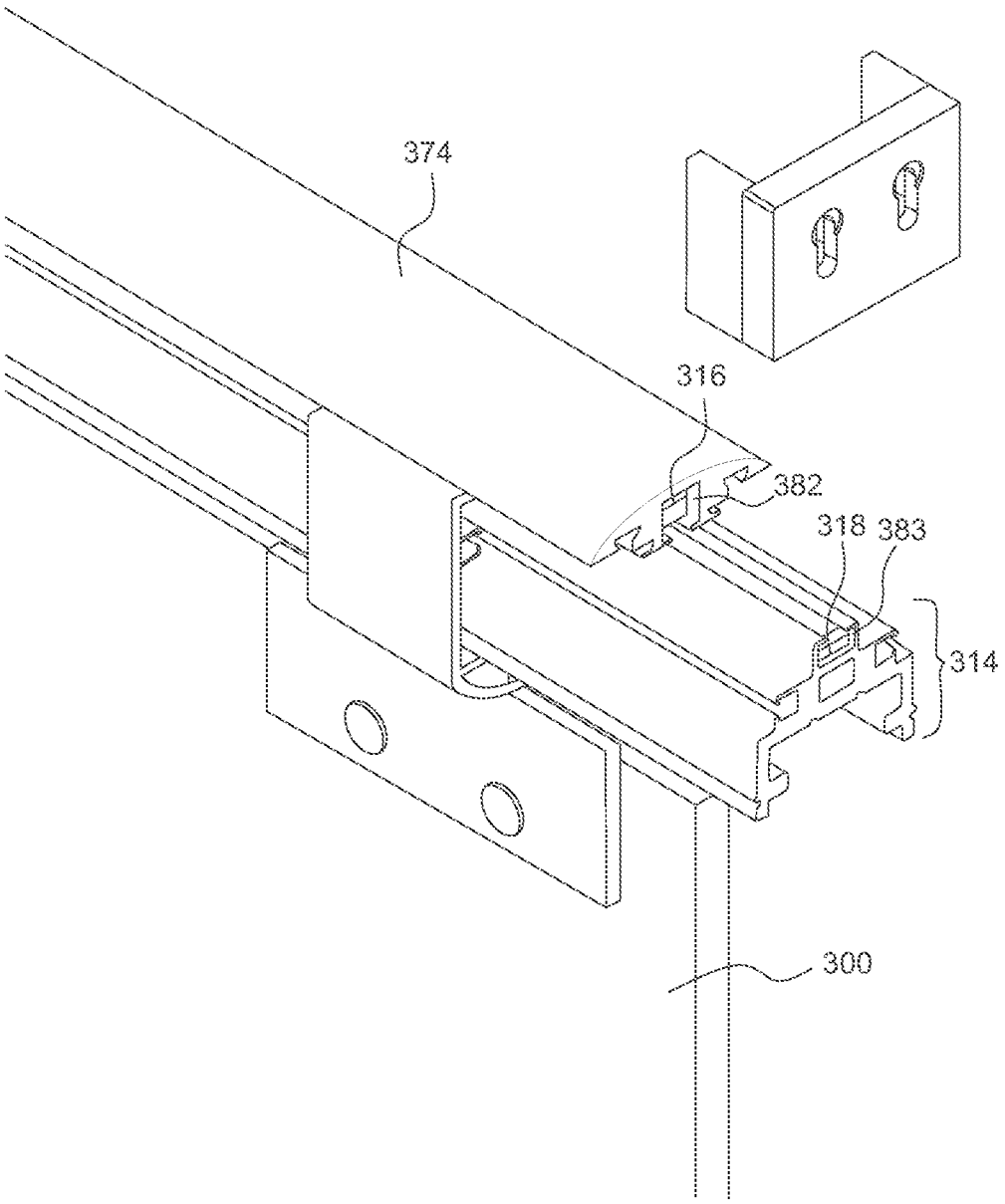
FIG. 14 is an enlarged assembled left perspective view of the shower door shown in FIG. 10.

Referring now to FIGS. 7-9, shower 220 is shown. The shower may have a stationary glass door 226 and a sliding glass door 200. The sliding glass door 200 slides left and right in the direction of arrow 212. The sliding door 200 may be supported by a magnet 216 embedded at a lower end portion of the door 200 and the magnet 218 embedded within a sill 230. The magnet 218 may extend across at least 80% to 90% of the length 240 of the sill 230. The magnet 216 may extend about 80% to 90% of the length 236 of the door 200 so that the magnet 218 and the magnet 216 may evenly lift the door 200 vertically upward. The door 200 may have an elongate slot 284 that fits or receives an elongate tongue 286 formed in the sill 230. The bottom end portion of the door 200 may fit within a U-channel 288. The tongue 286 is sufficiently long so that the repelling forces generated by the magnets 216, 218 do not dislodge the tongue 286 from the groove 284. The upper end portion 280 of the door 200 may be received into a U-channel 290. Rollers 262 may stabilize the upper end portion of the door.

The length 240 of the magnet 218 attached or embedded into the sill 230 may be about equal to twice the length 236 of the glass door 200 that slides back and forth. A length 238 of the magnet 216 disposed at the bottom portion of the glass door 200 may be about 80% to 100% of a length 236 of the glass door 200.

The bottom end of the door 200 may have rollers that roll on a bottom surface of the U-channel 288 so that if the repelling forces created by the magnets 216, 218 are not sufficient to lift the door fully upward, the rollers will support the door and allow the door to slide left to right. The rollers may be placed on both sides of the vertical midline 292 of the door 200 so that the rollers can evenly support the door 200 when it is being slid back and forth.

Additionally, the magnet 216 is shown and described as being a single elongate magnet that extends across more than 50% of a length 236 of the door 200. However, it is also contemplated that the magnet 216 may be a plurality of magnets that are distributed along the length 236 of the door 200 to evenly lift the door 200 upward. By way of example and not limitation, the magnet 216 may be two (2) separate magnets that are placed on both sides of the vertical midline 262 at he lower end portion of the door 200. The repelling force may be adjusted by adjusting a length, width, height of the magnets 216, 218.

Referring now to the FIGS. 10-15, a shower 320 is shown. The shower head and the walls 22, 24 are not shown for the purposes of clarity. The shower 320 may have a stationary glass door 326 that may be secured to the first wall 22 (not shown) with brackets 328. The stationary glass door 326 may be laterally offset from the sliding glass door 300 so that the sliding glass door 300 may be laterally side to side with the stationary glass door 326 when a user wants to enter the shower or exit the shower 320. The sliding glass door 300 may also be transitioned to the closed position shown in FIG. 10 to prevent water from escaping out of the shower 320 when the shower 320 is in use. As the glass door 300 is slid from the opened position to the closed position, the weight of the glass door 300 may be fully or substantially supported by the repelling forces of the magnets 316, 318 shown in FIG. 14.

The track 314 may extend from the first wall to the second wall and may be secured with a bracket and a fastener. The track 314 may have an elongate magnet 318 that may extend substantially along the length of the track 314 or fully along the entire length of the track 314 so that the magnets 316 are always repelled by the magnet 318 when the door 300 is in the opened position, the closed position or transitioned therebetween. In the example shown in FIG. 10, a length 336 of the stationary door 326 may be about equal to a length 338 of the sliding door so that the door 300 may be fully slid away in the opened position. In this regard, the length of the magnet 318 may be about equal to twice or slightly less than twice the length 338 of the sliding door 300.

The sliding door 300 may be attached to at least two brackets 342 and a top member 374. The top member 374 is long enough to secure the brackets 342 to the top member 374. The brackets 342 may be attached to the sliding door 300 at the upper end portion of the sliding door 300. The top member 374 may be attached to the bracket 342 by way of a tongue and groove connection 376. In particular, the top member 374 may have a V-notch on the left and right sides thereof 374. The brackets 342 may have a housing 378 with matching V-configured tongues. The V-configured tongues may slide into the V-configured notch of the top member 374 and be held in place by an adhesive or a set screw. The housing 378 of the bracket 342 may be attached to a pair of plates that are secured to the glass door 300. The pair of plates 380 sandwich the door 300 and are secured to the housing 378 with a bolt 381.

The two brackets 342 may be attached to the door 300 on either side of the vertical midline 344 of the door 300. The brackets 342 may be spaced apart from the vertical midline 344 at an equal distance from the vertical midline 344 so that the repelling forces of the magnets 316, 318 may be evenly applied vertically up to hold the door 300 level and so the brackets 342 do not contact the track 314 or do so minimally. The magnet 316 may be embedded in the top member 374 within a cavity 382 that extends along the length of the top member 374. The magnet 316 may be a single elongate magnet that extends across at least 50% of the top member 374 up to the entire length of the top member 374. The magnet 316 may be positioned so that it is evenly distributed on the vertical midline 344 when assembled.

It is also contemplated that the magnet 316 may be a plurality of magnets 316. In this case, the plurality of magnets may be evenly distributed along the length of the top member 374 so that the repelling forces generated by the magnets 316, 318 apply even upward forces on brackets 342. This is to allow the magnets 316, 318 to hold the door 300 in a level position.

The track 314 may also have a cavity 383 that receives the magnet 318. Magnet 318 may extend across the entire length of the track 314 or a sufficient length of the track 314 so that the magnets 316 embedded in the top member 374 are always being repelled away by magnets 318. By way of example and not limitation, the magnet 318 may extend across 80% or 90% of the length of the track 314. The magnets 316, 318 may be embedded and held in place in cavities 382, 383 with an adhesive or other attachment mechanism such as a screw. The repelling forces generated by the magnets 316, 318 may be equal to the weight of the sliding door 300 including the bracket 342, top member 374 and the magnet 316 and other components that may be attached to the sliding door or move with the sliding door as the sliding door 300 traverses between the closed and opened position. The configuration of the magnets 316, 318 may be identical to the configuration of the magnets 16, 18 in relation to the embodiment shown in FIGS. 1-3 except that the magnet 316 may be distributed about a longer length because of the top member 374 as discussed above. The top member 374 is longer and the magnet 316 embedded in the top member 374 can be distributed along a longer length.

Figure 15:
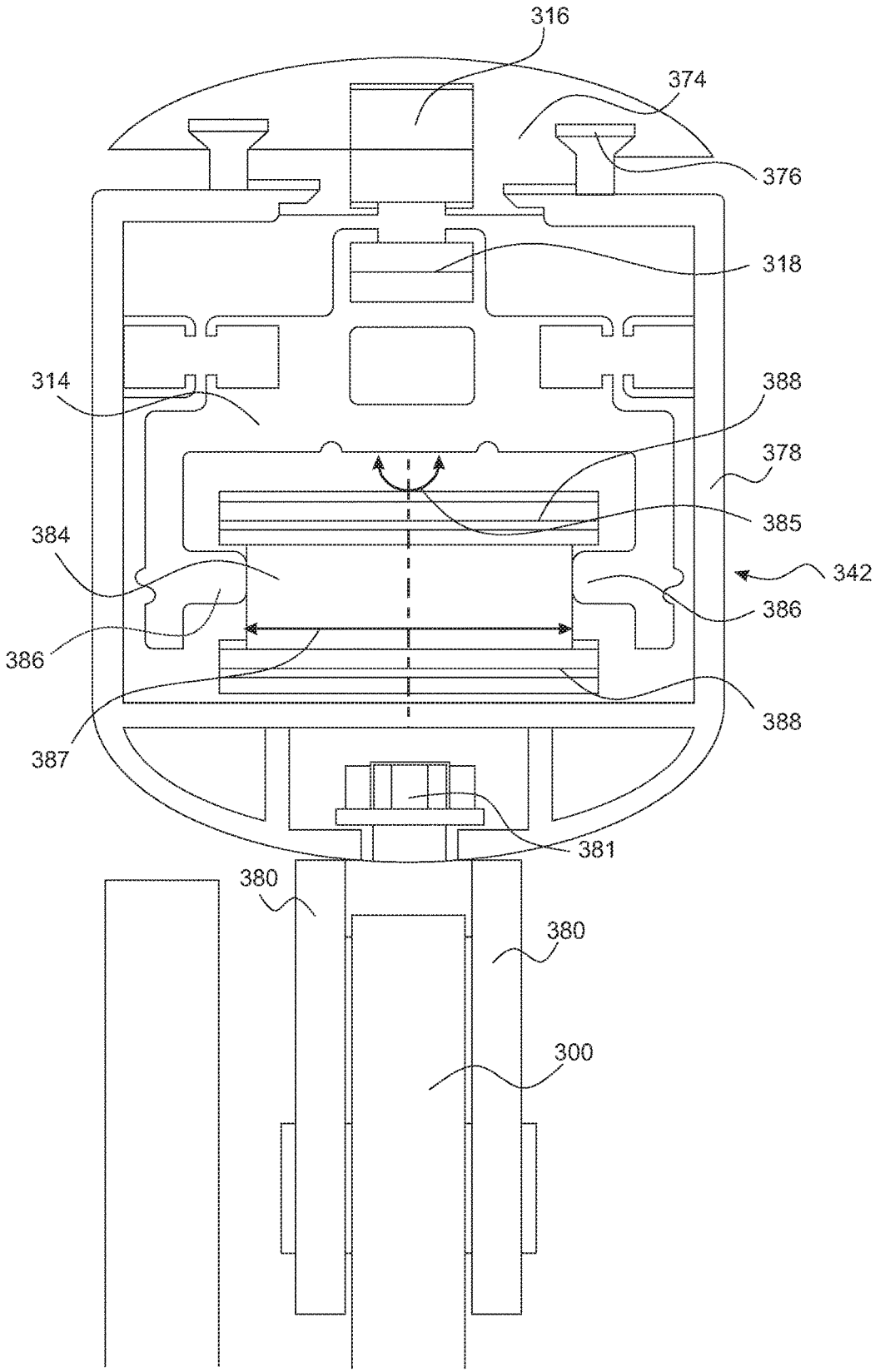
FIG. 15 is a cross-sectional view of the shower door shown in FIG. 10.
Figure 16:
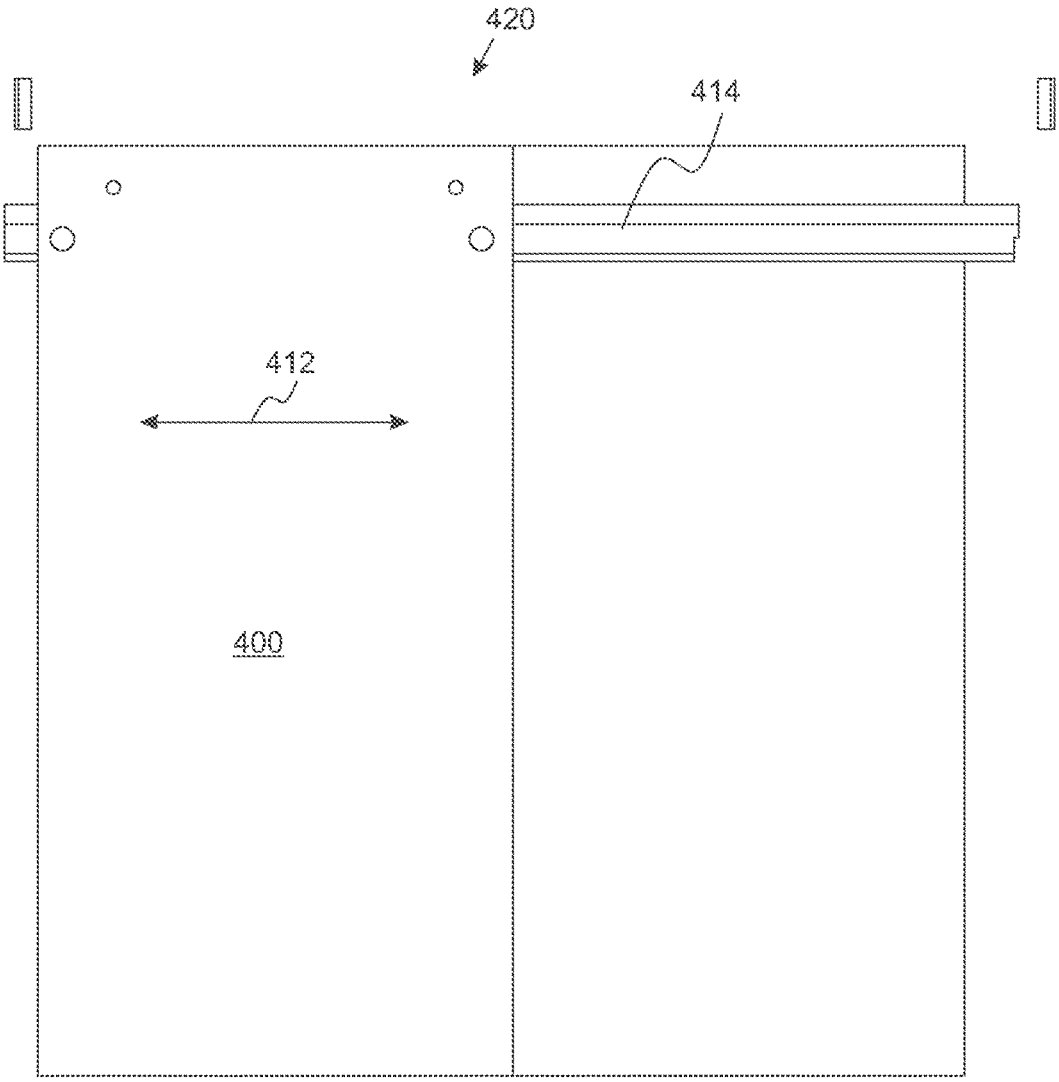
FIG. 16 is a front view of a fifth embodiment of the shower door.
Figure 17:
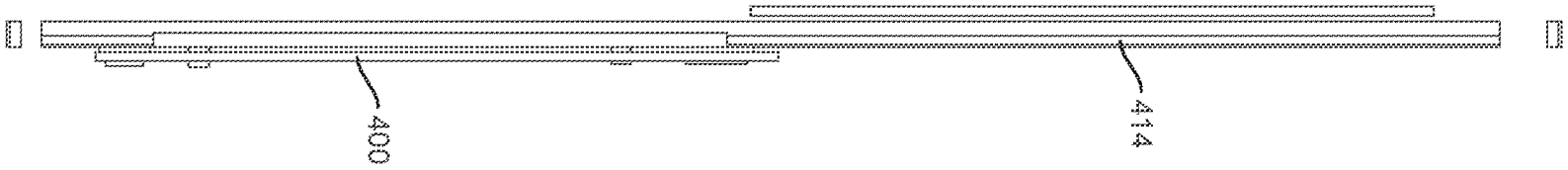
FIG. 17 is a top view of the shower door shown in FIG. 16.
Figure 18:
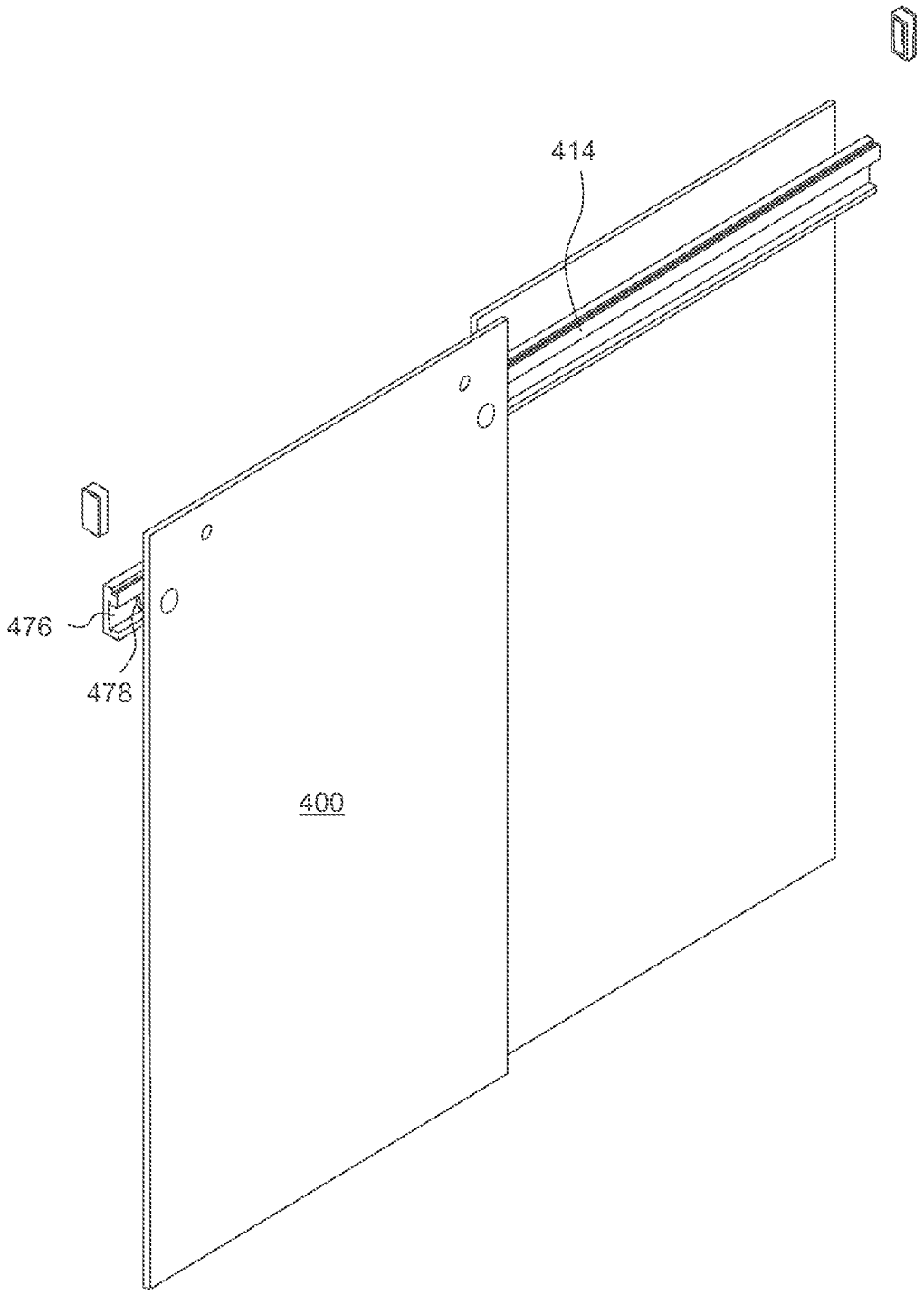
FIG. 18 is a right perspective view of the shower door shown in FIG. 16.
Figure 19:
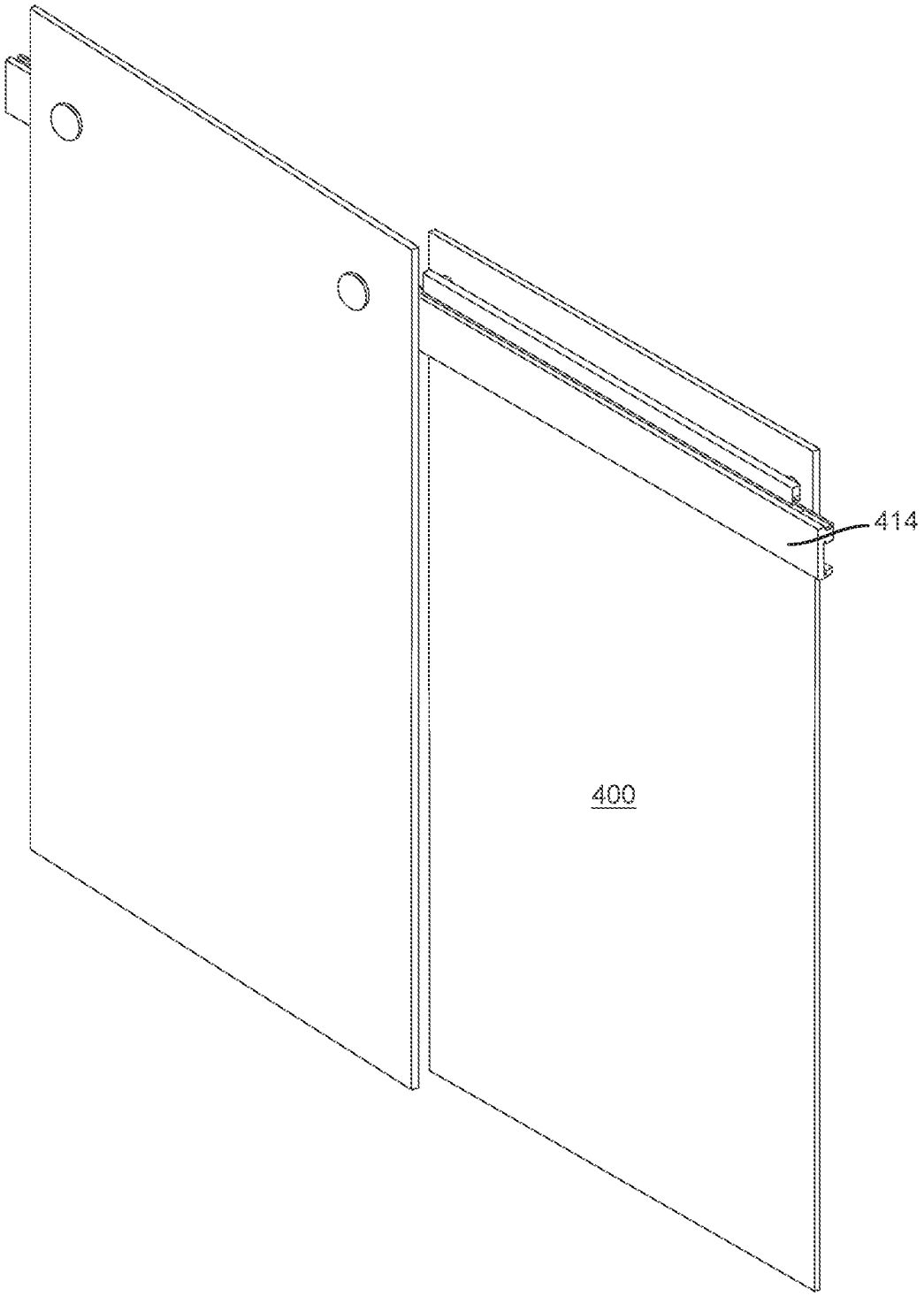
FIG. 19 is a left perspective view of the shower door shown in FIG. 16.
Figure 20:
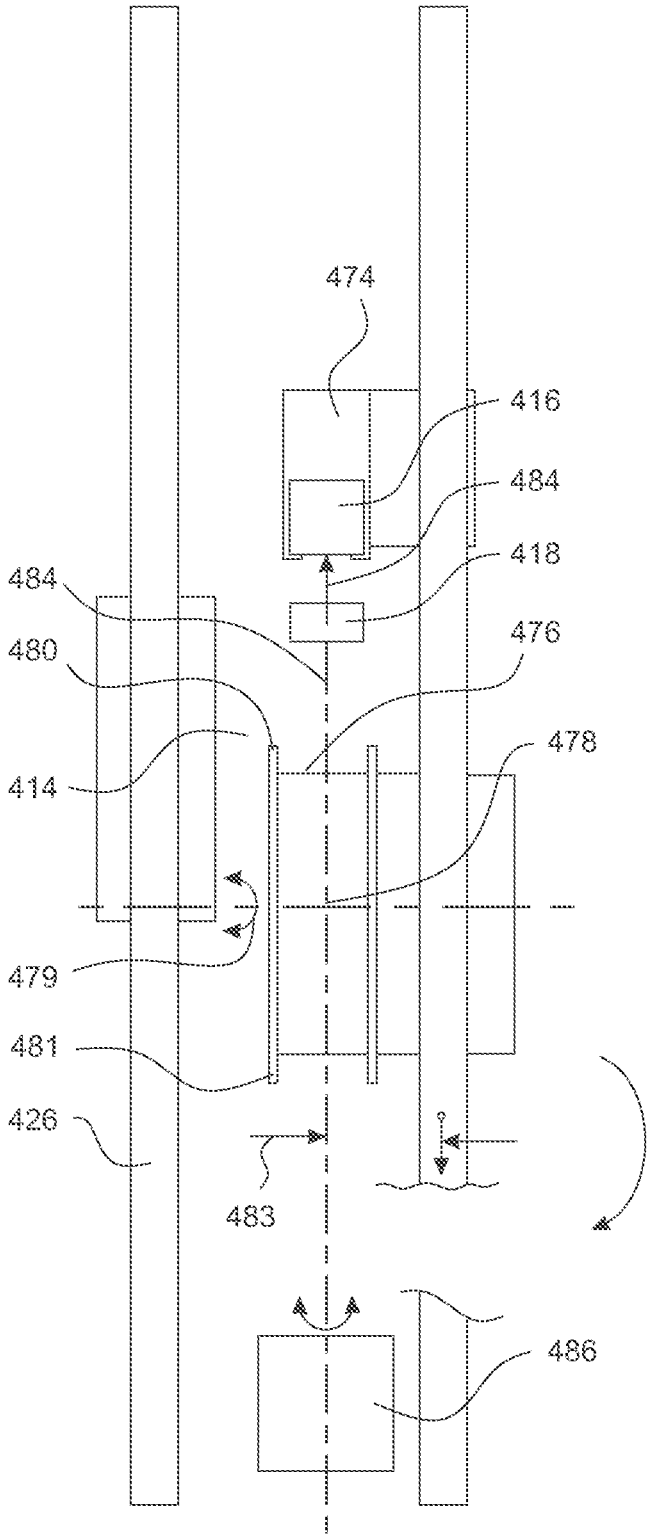
FIG. 20 is a cross-sectional view of the shower door shown in FIG. 16.
Figure 21:
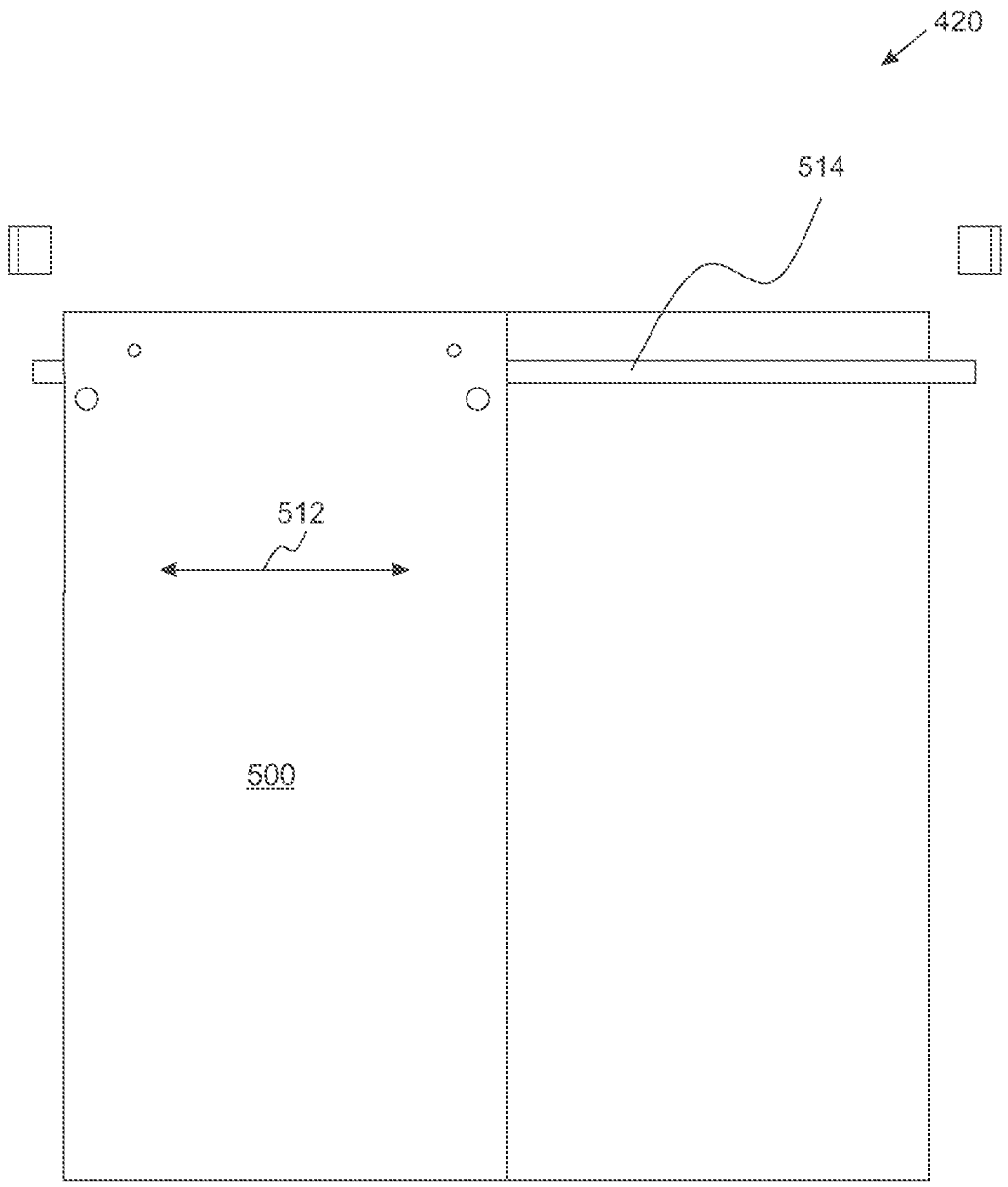
FIG. 21 is a front view of a sixth embodiment of the shower door.
Figure 22:
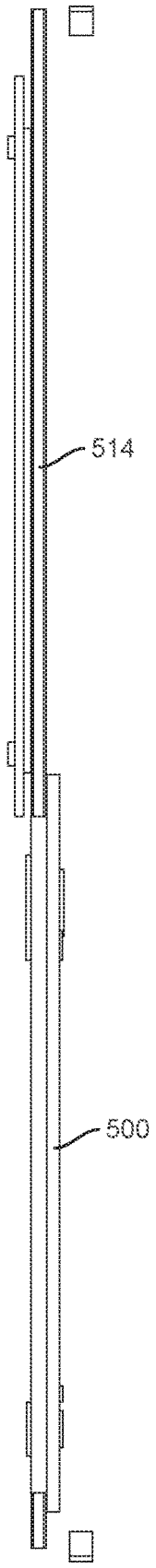
FIG. 22 is a top view of the shower door shown in FIG. 21.
Figure 23:
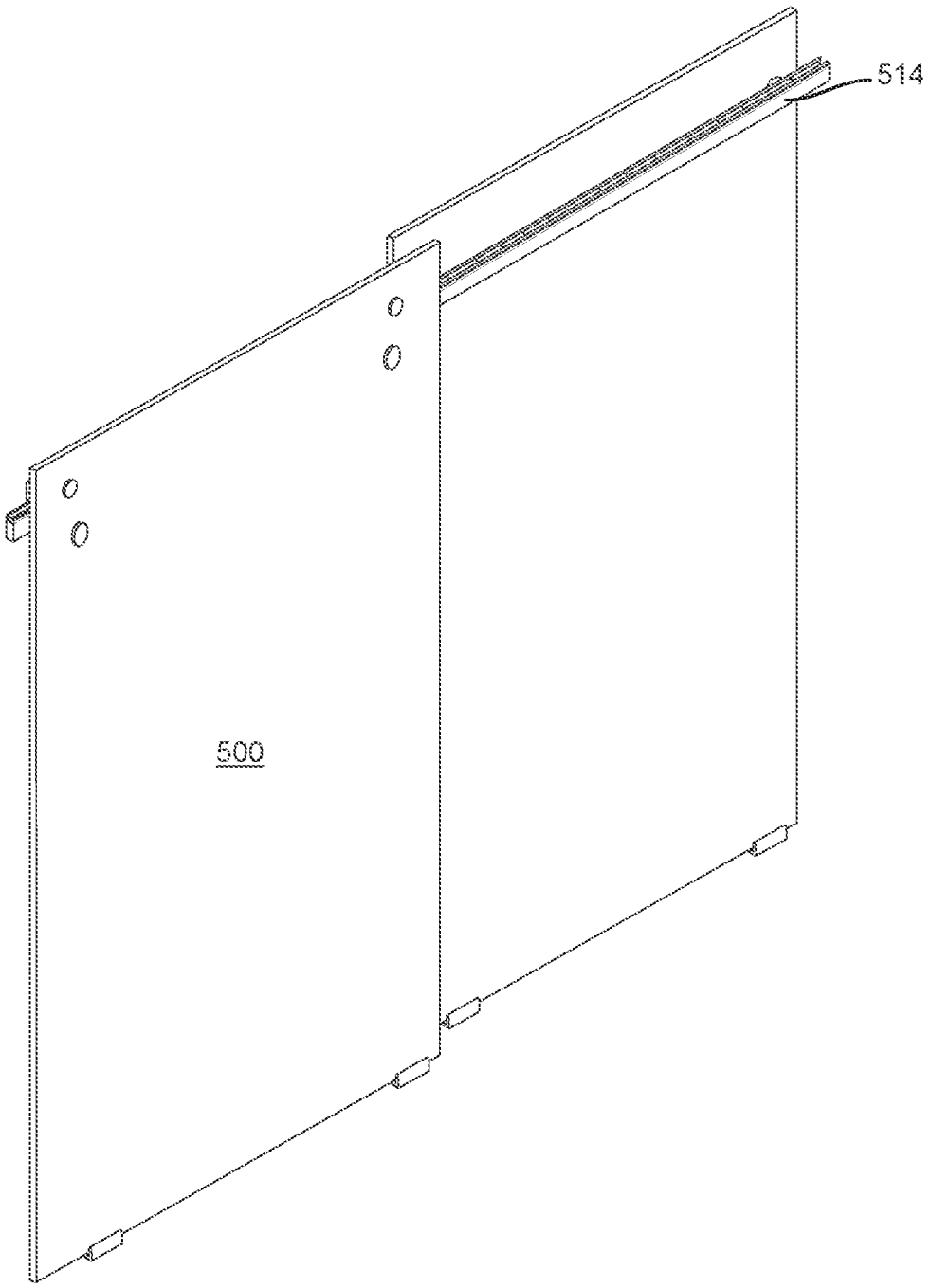
FIG. 23 is a right perspective view of the shower door shown in FIG. 21.
Figure 24:
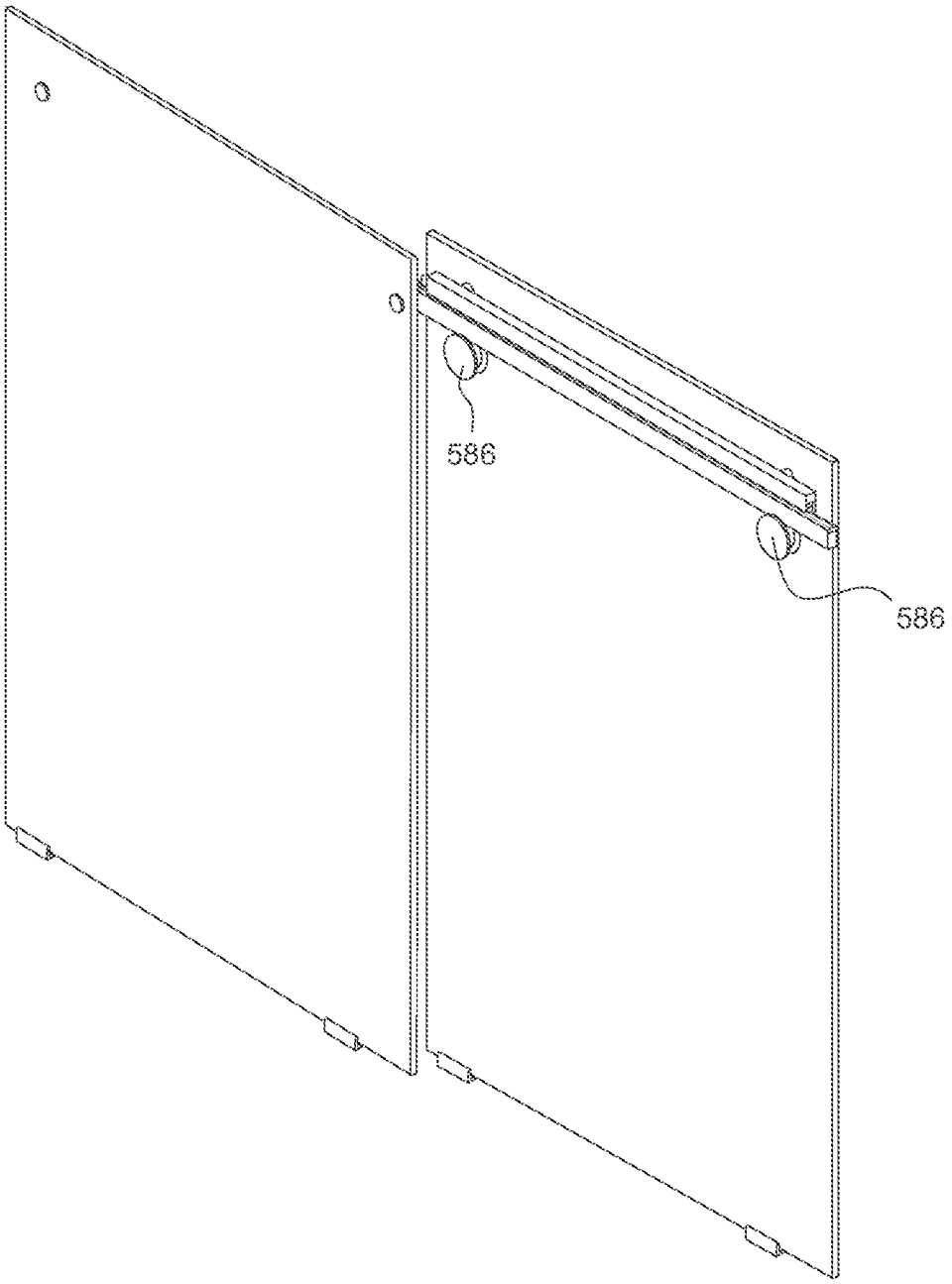
FIG. 24 is a left perspective view of the shower door shown in FIG. 21.
Figure 25:
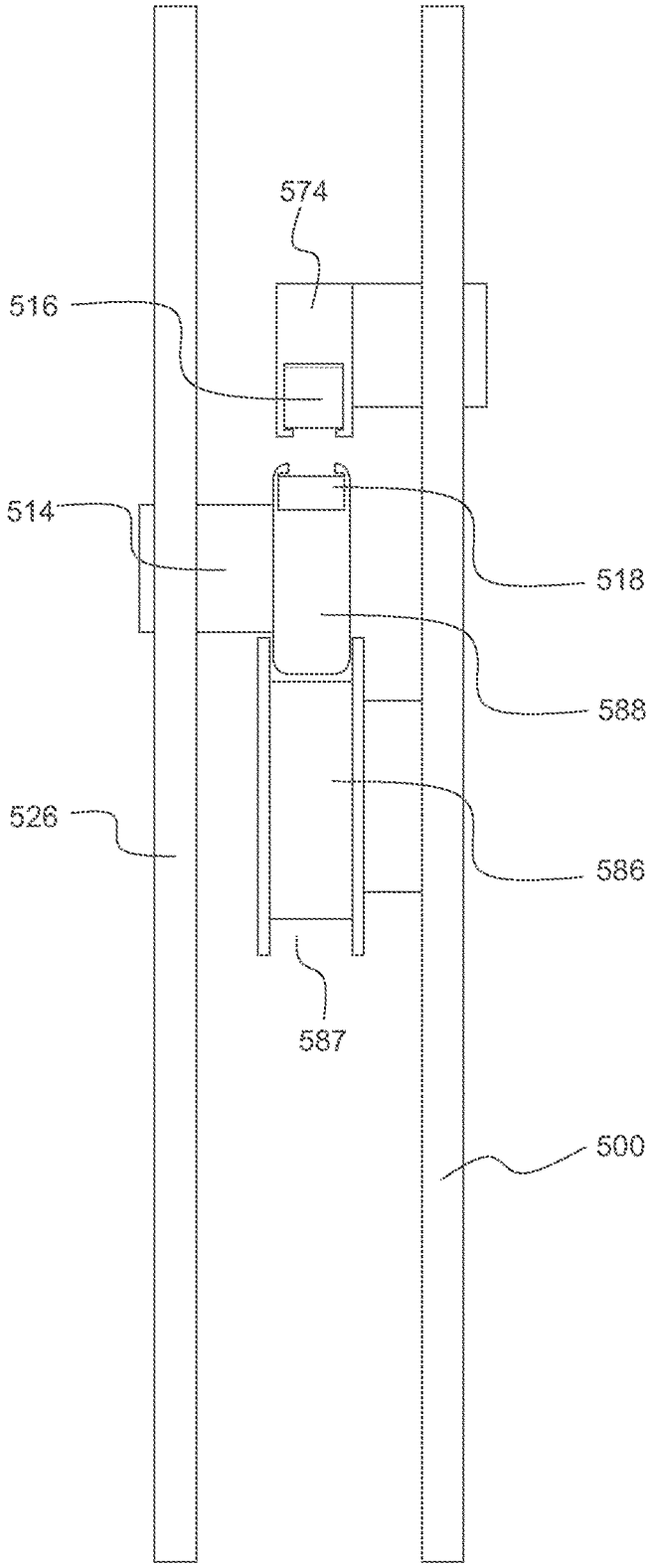
FIG. 25 is a cross-sectional view of the shower door shown in FIG. 21.
Figure 26:
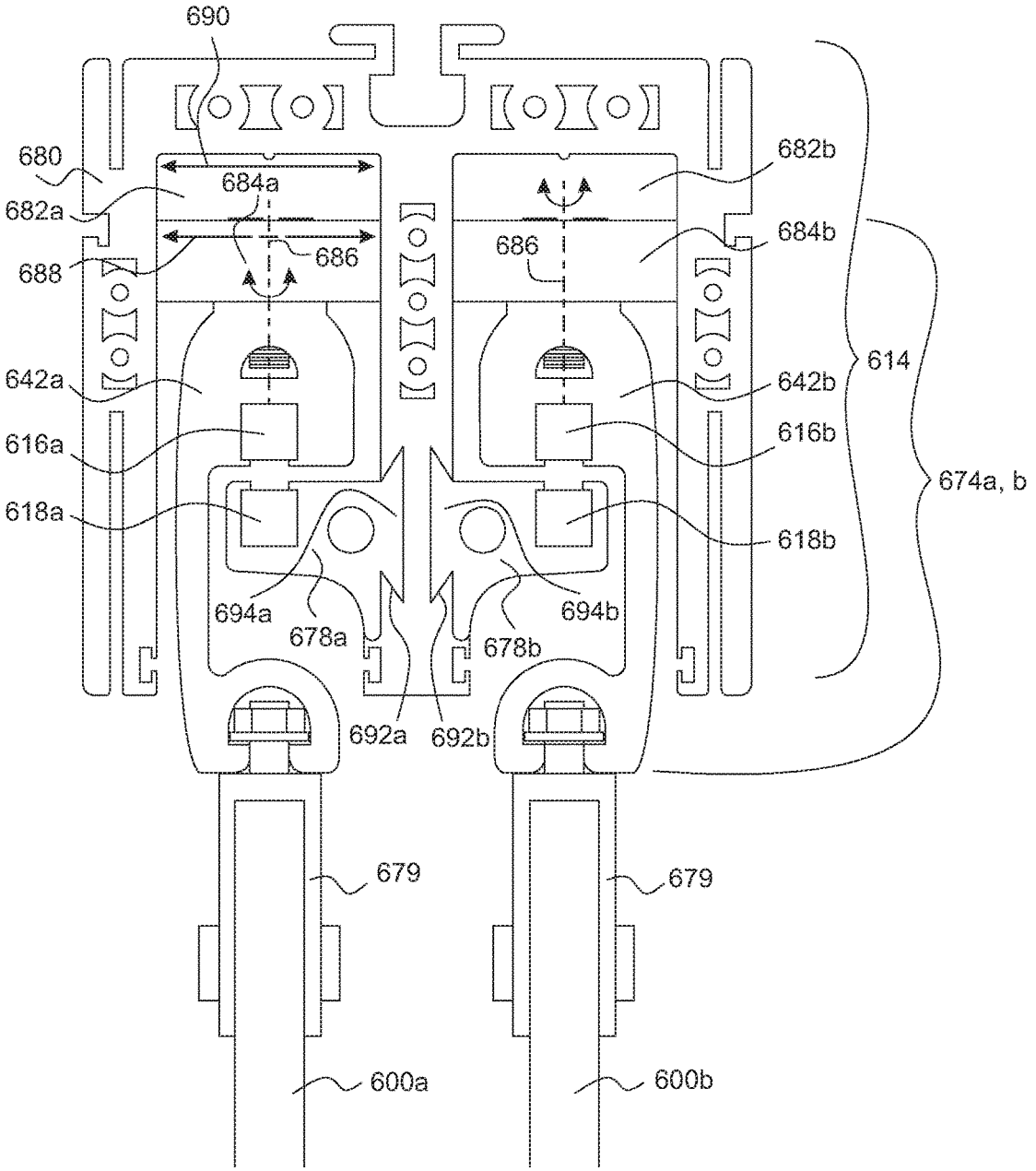
FIG. 26 is a cross-sectional view of a seventh embodiment of the shower door illustrating a door, track and bracket.
Figure 27:
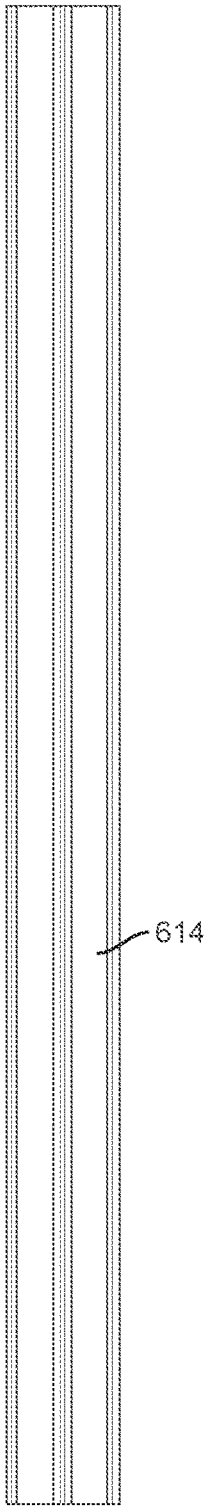
FIG. 27 is a top view of the shower door shown in FIG. 26.
Figure 28:
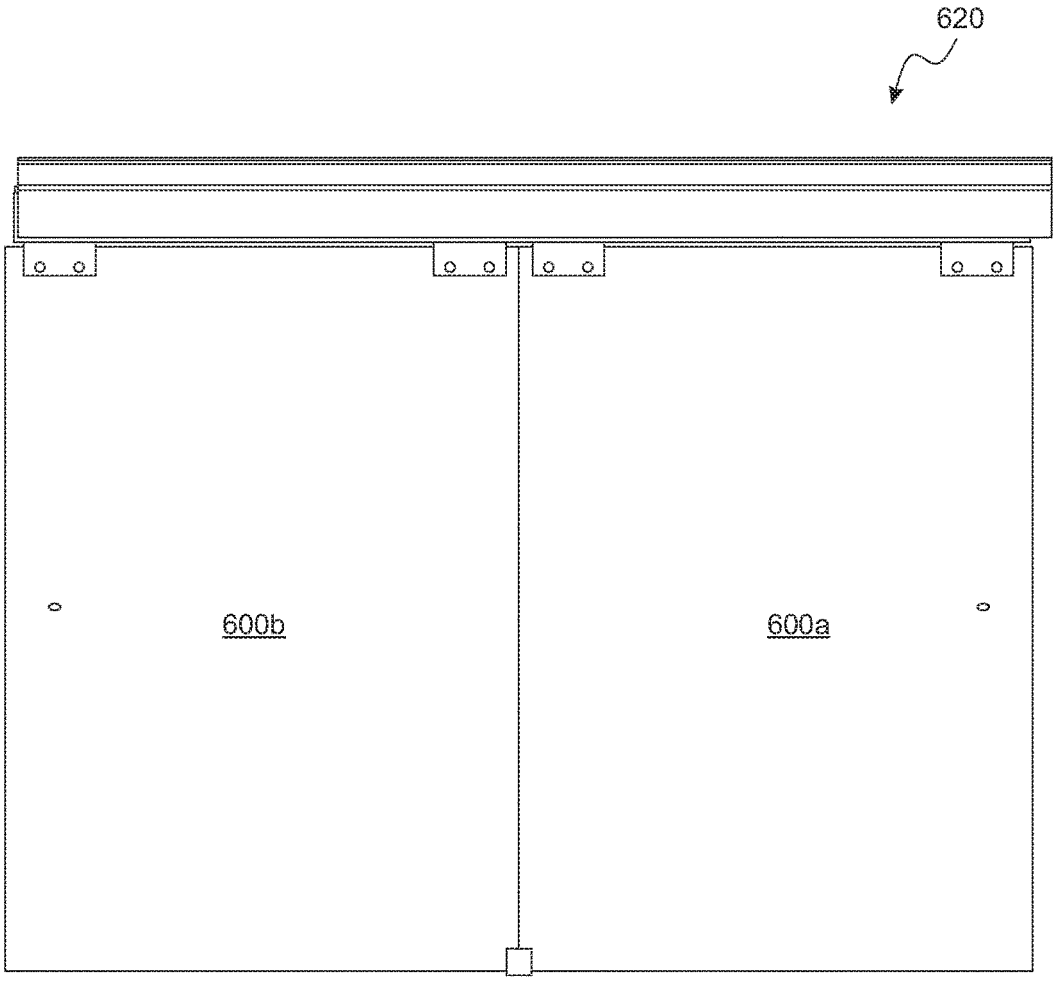
FIG. 28 is a front view of the shower door shown in FIG. 26.
Figure 29:
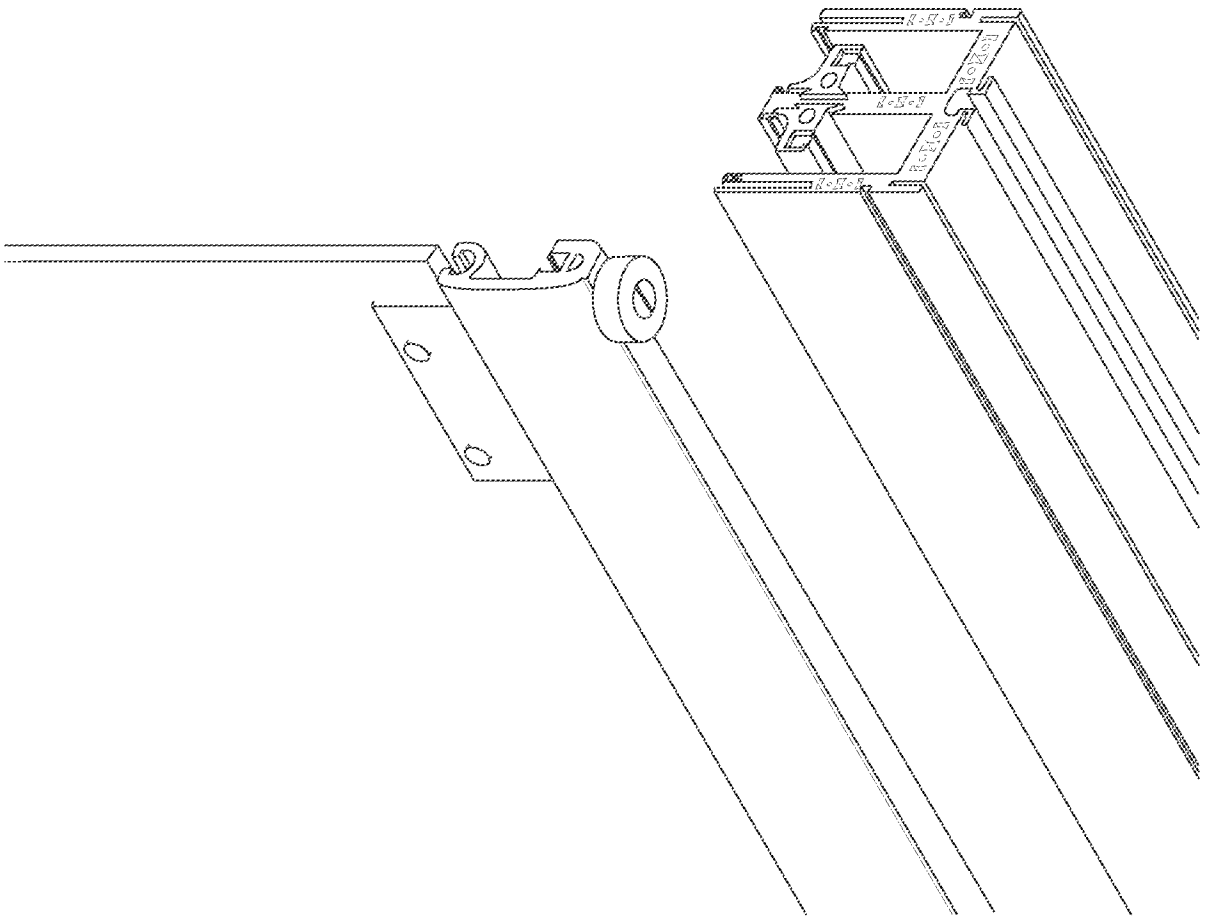
FIG. 29 is an exploded right perspective view of the shower door shown in FIG. 26.

Referring now to FIG. 15, the housing 378 may have a stabilizing roller 384. There may be two stabilizing rollers 384 for the door 300. The stabilizing roller 384 may be hidden within the housing 378 of each of the brackets 342. The stabilizing roller 384 may rotate as shown by arrow 385. The track 314 may have inwardly directed fingers 386. A distance between the fingers 386 may be equal to or slightly greater than a diameter 387 of the stabilizing roller 384. By way of example and not limitation, the distance between the fingers 386 may be about one thousandths of an inch to about a quarter of an inch greater than the diameter 387 of the stabilizing roller 384. The stabilizing roller 384 is rotatably attached to the housing 378. The stabilizing roller 384 may have upper and lower ridges 388 that hold the fingers 386 therebetween. In this regard, the door 300 may be traversed vertically by an amount equal to that which the fingers 386 may be traversed between the ridges 388. In this regard, the magnets 316, 318 repel each other and vertically displace the door 300 upward until the repelling forces generated by the magnets 316, 318 are equal to the weight of the door 300. This is also how the other embodiments disclosed herein operate in order to equalize the repelling forces of the magnets and the weight of the sliding door.

Referring now to FIGS. 16-20, a fifth embodiment of the shower 420 is shown. Similar to the shower 320, the walls and the showerhead are not shown. The shower 420 may have the track 414 extended between the walls and are attached to the walls 22, 24. The track 414 may have an extruded configuration as that shown in FIG. 20. The stationary door 426 may be attached to the track 414 with screws. The sliding door 400 may be held vertically up by repelling forces generated by magnets 416 and 418. The repelling magnet 416 is fixedly attached to the sliding door 400. By way of example and not limitation, the sliding door 400 may have a magnet receiving member 474 that is attached to the glass door 400 by way of a screw. The magnet receiving member 474 may have a receiving cavity that receives either one or more magnets 416. The magnet 416 may be a single elongate magnet 416 that extends along the entire length of the magnet receiving member 474. Alternatively, if there is a plurality of magnets 416, then the plurality of magnets may be evenly distributed along the length of the magnet receiving member 474.

The distribution of the magnets 416 may follow the same guidelines as that of the magnets 316 discussed in relation to the fourth embodiment of the shower door 320. Additionally, the magnet 418 may be embedded within the track 414 similar to the magnet 318 in relation to the track 314.

The track 414 may have a groove 476. The groove 476 may receive one or more wheels 478 that are attached to the sliding door 300. For example, as shown in the figures, the sliding door 300 may have two wheels 478 that are horizontally level with each other. The wheels 478 may ride within the groove 476 of the track 414.

The wheels 478 may be rotatable in direction of arrow 479 about a central axis. The wheels 478 may rotate as they 478 are traversed within the groove 476 of the track 414. Preferably, the wheel 478 does not touch the track 414 as the sliding door 400 is traversed between the opened and closed positions. Rather, the repelling force generated by the magnets 416, 418 should be counterbalanced by the weight of the door 400. More particularly, the repelling force of the magnets 416, 418 may be equal to a weight of the door. The wheels 478 preferably do not carry any weight of the door 400. However, the wheel or wheels 478 may have ridges 480 that are received into slots 481 formed in the groove 476. In this manner, the door 400 is not allowed to slide off of the track 414.

The weight of the door 482 is represented by arrow 482 and is offset 483 to the upward force 484 generated by the magnets 416, 418. The repelling force of the magnets 416, 418 is represented by arrow 484. This offset 483 will cause the door to rotate in the direction of arrow 485. In order to keep the door 400 in a vertical orientation, a roller 486 may be disposed on a medial side of the door 400 at the lower end portion of the door 400 and be positioned so as to maintain the door 400 in a vertical orientation. The roller 486 may rotate as the door pushes against the roller 486 and the door 400 is traversed between the opened and closed positions.

Referring now to FIGS. 21-25, a sixth embodiment of the shower 520 is shown. The sixth embodiment shown in FIGS. 21-25 operates identical to the fifth embodiment of the shower 420 except for the following. The track 514 is attached to the walls 22, 24. The stationary door 526 is attached to the track 514. The track 514 and the magnet receiving member 574 which is attached to the sliding door 500 has embedded magnets 516, 518 that produces a repelling force to lift the door 500 and prevent any contact therebetween. The sliding door 500 may have two rollers 586. Each roller 586 may have a groove 587. The track 514 may have an extended tongue 588 that is received into the groove 587 of the roller or wheels 586. This enables or prevents or mitigates the door 500 from sliding off laterally from the track 514.

Referring now to FIGS. 26-30, a seventh embodiment of the shower 620 is shown. The seventh embodiment shown in FIGS. 26-30 operates identical to the other embodiments discussed herein except as discussed below. The track 614 may be attached to the walls. One or both doors may be traversed left to right. The track 614 and a magnet receiving member 674*a, b* which may be attached to the door 600*a*, 600*b* may have magnets 616*a, b*, 618*a, b* embedded therein that produces a repelling force to lift the door 600*a, b* and prevent any contact therebetween.

The track 614 may be a single elongate extruded piece of aluminum or other suitable material. Alternatively, the track 614 may be fabricated from multiple elongate extruded pieces of aluminum that are assembled together. By way of example and not limitation, the track 614 may have extruded inserts 678*a, b*. In this regard, the track 614 may include a base 680 and the two inserts 678*a, b*. The base 680 may have a cavity 682 that receives the magnet receiving member 674*a, b*. In particular, the base 680 may have cavities 682*a, b* that each individually receives the magnet receiving members 674a, b and the inserts 678a, b. The inserts 678*a, b* may be received into cavities 692*a, b*. The inserts 678*a, b* may have a base 694*a, b*.The base 694*a, b* may have a matching configuration compared to the cavities 692*a, b*. By way of example and not limitation, the base 694*a, b* and the cavities 692*a, b* may have matching trapezoidal configurations. The base 694*a, b* may freely slide into the cavities 692*a, b*. The base 694*a, b* may be held into place with an adhesive (e.g. silicone). The base 680 and the inserts 678*a, b* may be sufficiently long so that the opposing ends are attached to the walls 22, 24. In contrast, the magnet receiving members 674*a, b* may be sufficiently long to extend across a substantial part or the entire width of the door 600*a, b*. More particularly, the magnet receiving member may comprise bracket 642 which extends across the substantial part or the entire width of the door 600*a, b*.

Figure 30:
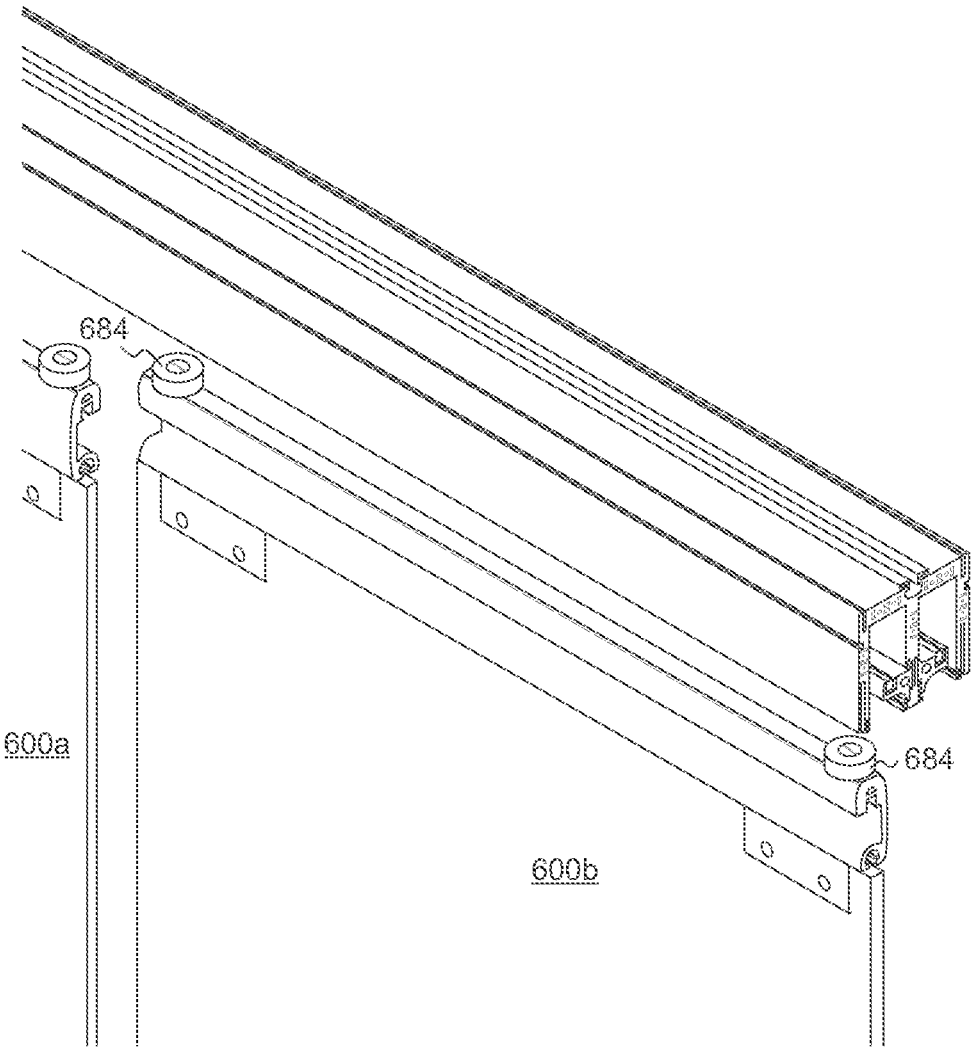
FIG. 30 is a left perspective of the shower door incorporating the shower door shown in FIGS. 26-29.

Also, the magnet receiving members 674*a, b* may have stabilizing rollers 684*a, b* on opposed ends of the doors 600*a, b*, as shown in FIG. 30. The stabilizing rollers 684 may be rotatable about a vertical axis 686. The stabilizing rollers 684 may have a diameter 688 which is slightly smaller than a distance 690 of the cavities 682a, b. When the door 600*a, b* slides left to right, the rollers 684 maintain vertical alignment of the magnets 616*a, b*, 618*a, b* and the door 600*a, b*.

The bottom side of the bracket 642*a, b* may have a bracket 679 which attaches the glass door 600*a, b* to the bracket 642*a, b* of the magnet receiving member 674*a, b*.

Figure 31:
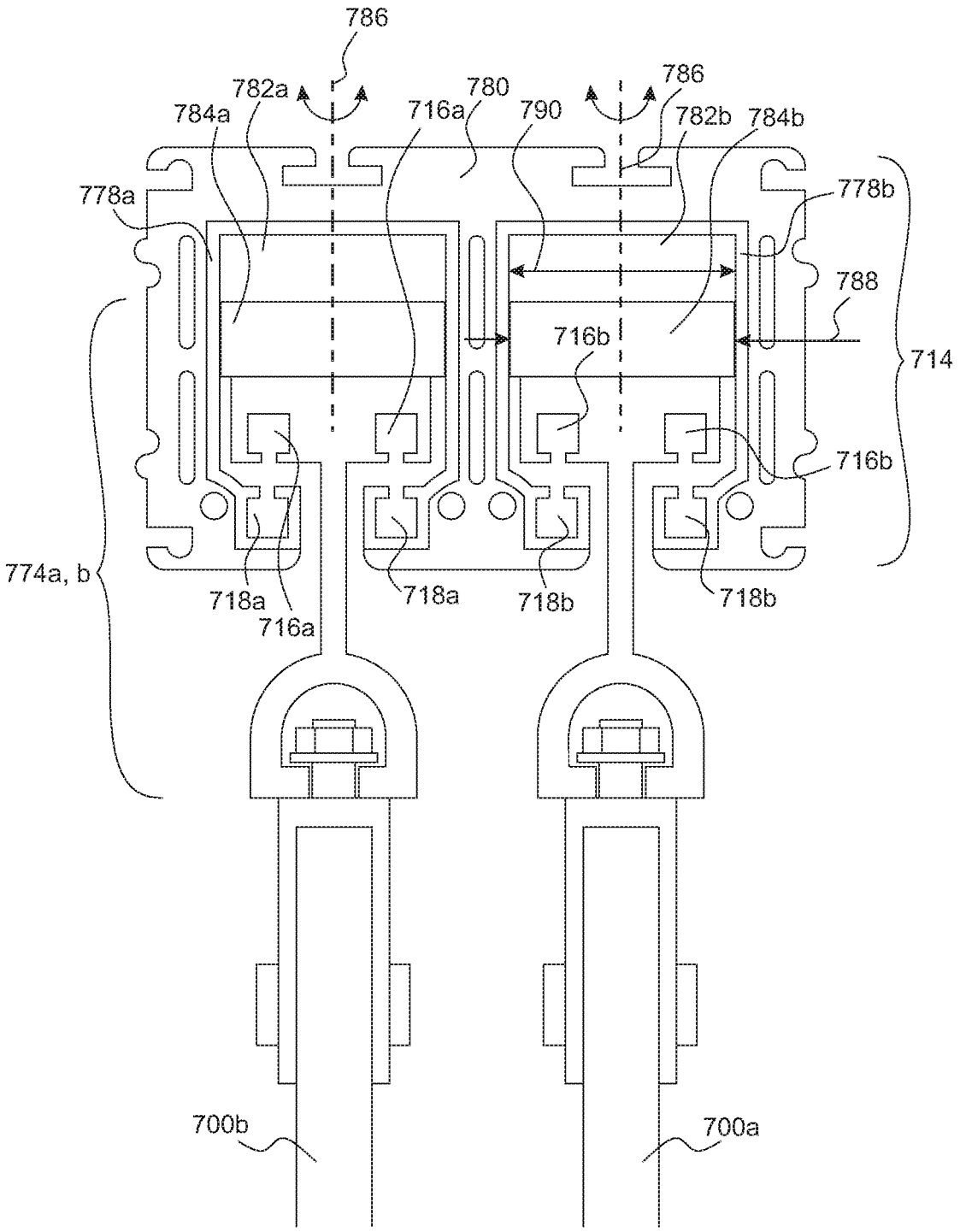
FIG. 31 is a cross-sectional view of an eighth embodiment of the shower door illustrating a door, track and bracket.
Figure 31A:
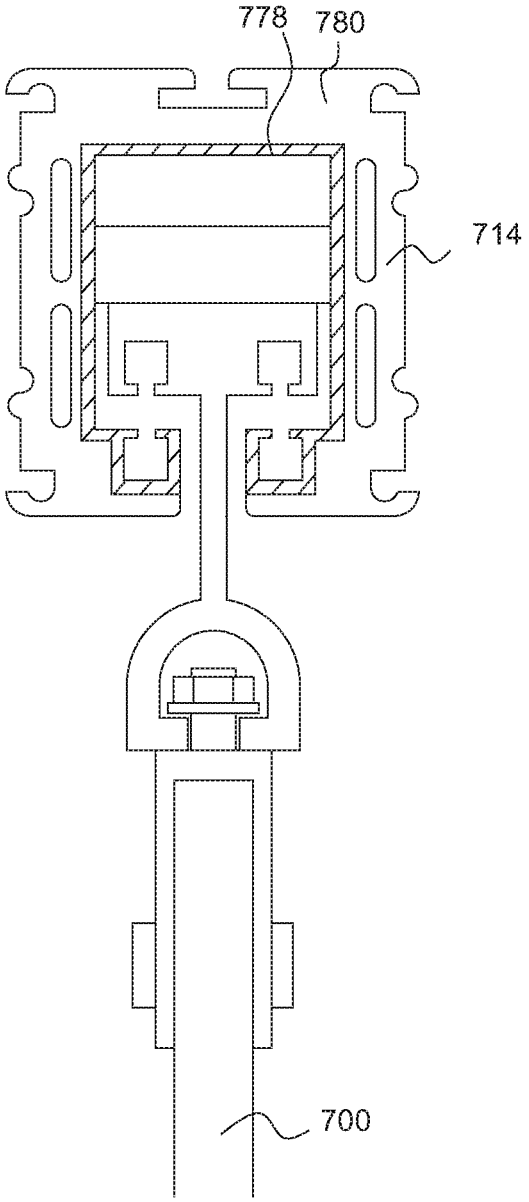
FIG. 31A is a variant of the cross-sectional view shown in FIG. 31.
Figure 32:
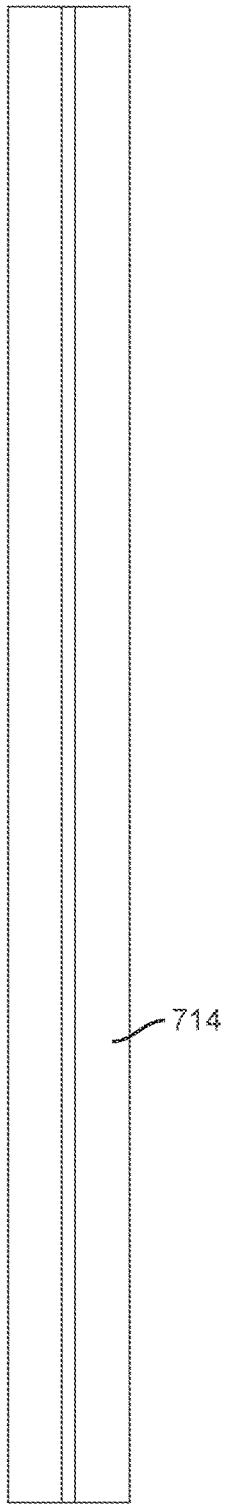
FIG. 32 is a top view of the shower door shown in FIG. 31.
Figure 33:
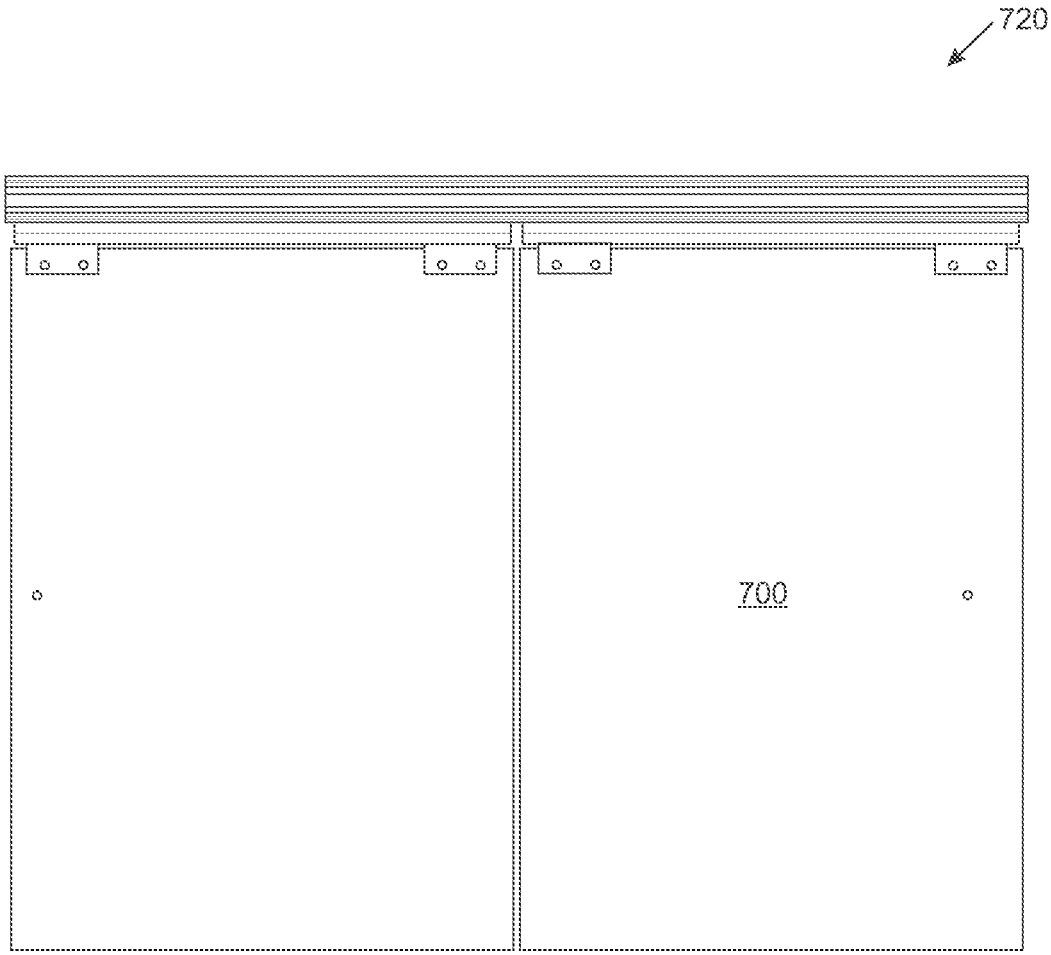
FIG. 33 is a front view of the shower door shown in FIG. 31.

Referring now to FIGS. 31-36, an eighth embodiment of the shower 720 is shown. The eighth embodiment shown in FIGS. 31-35 operates identical to the other embodiments discussed herein except as discussed below. FIG. 31 illustrates two doors 700*a, b* that slides left to right. In contrast, FIG. 31A illustrates a single door 700 that traverses the track 714 left to right. The other door which is not shown may be stationary. In FIG. 31A and the other embodiments discussed herein, the track may be attached above a door opening so that the door 700 can slide back and forth between an opened position to allow people and things to go through the opening and a closed position to block people and things from going through the opening.

The track 714 and a magnet receiving member 774*a, b* which may be attached to the door 700*a, b* may have magnets 716*a, b*, 718*a, b* embedded therein that produces a repelling force to lift the door 700*a, b* and prevent any or minimal contact therebetween.

Figure 34:
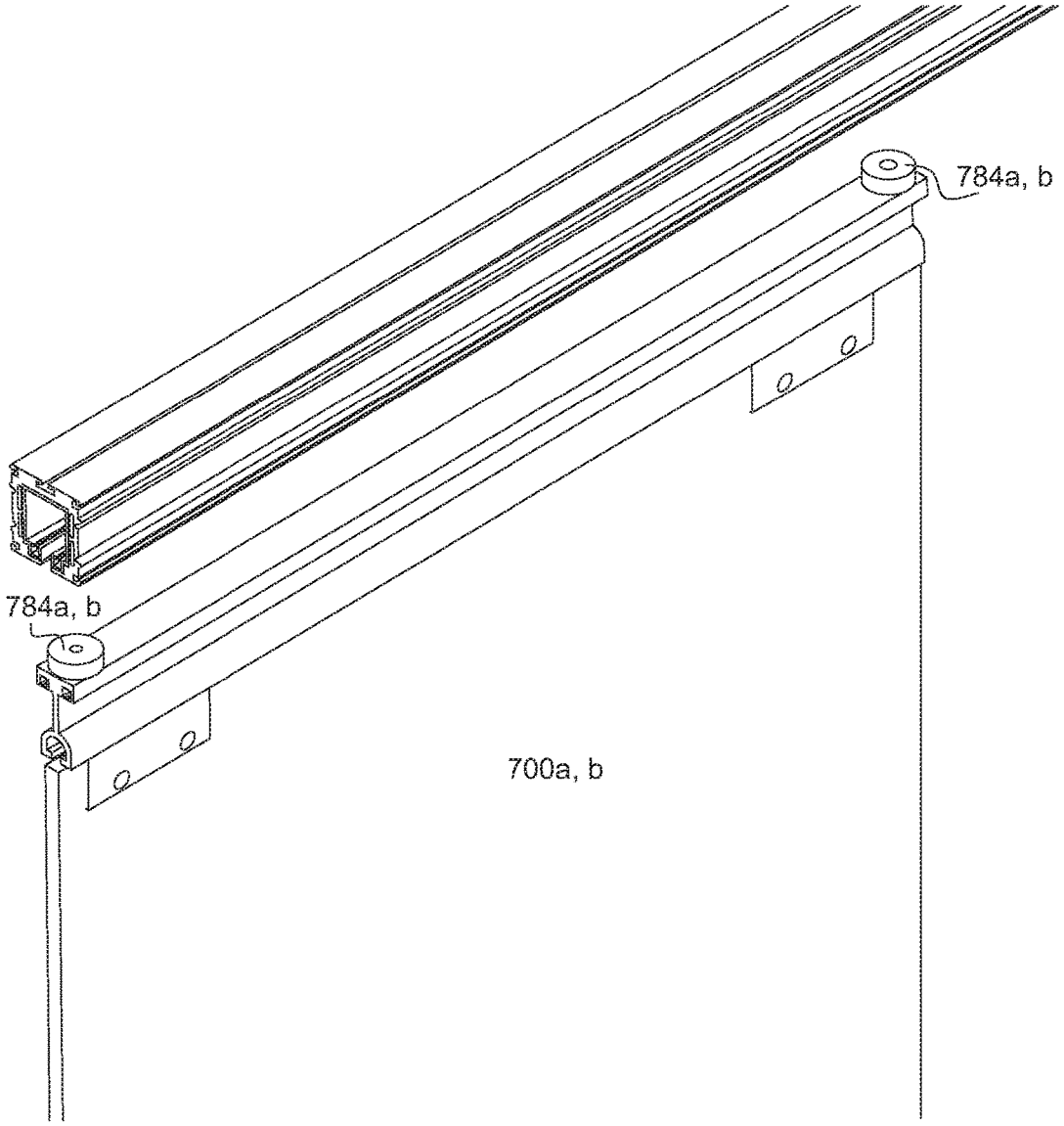
FIG. 34 is an exploded right perspective view of the shower door shown in FIG. 31.
Figure 35:
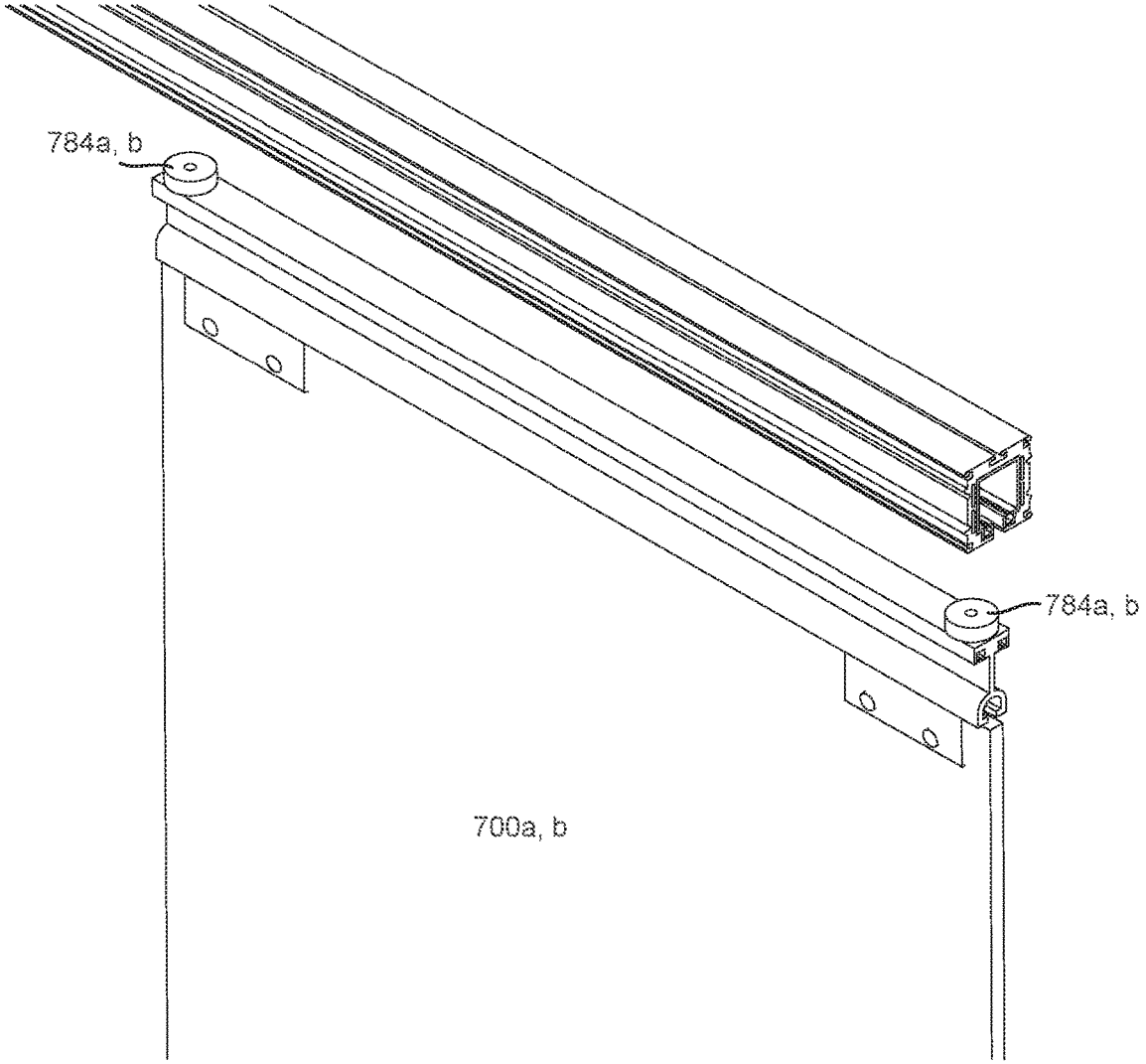
FIG. 35 is an exploded left perspective view of the shower door shown in FIG. 31.

The magnet receiving member 774*a, b* may have stabilizing rollers 784*a, b*. The stabilizing rollers 784*a, b* may be disposed on opposing ends of the doors 700*a, b* as shown in FIG. 34. The stabilizing rollers 784*a, b* may be rotatable about a vertical axis 786. The stabilizing rollers 784 may have a diameter 788 which is slightly smaller than a distance 790 of the cavities 782*a, b*. When the door 700*a, b* slides left to right, the rollers 784*a, b* maintain vertical alignment of the magnets 716*a, b,* 718*a, b* and the door 700*a, b* by pushing against the inside surface of the cavities 782*a, b.*

Moreover, the doors shown and described herein are described as being glass doors. However, it is also contemplated that the doors may be fabricated from other materials as well including but not limited to wood, plexiglass, and the like. In the various aspects and embodiments described above, the brackets were described as being equidistantly set apart from a vertical midline of the door. In this regard, the repelling forces generated by the magnets embedded in the brackets on opposed sides of the vertical midline are equal to each other. However, it is also contemplated that the repelling forces generated on opposed sides of the vertical midline may be located asymmetrically about the vertical midline and also generate asymmetrical repelling forces but yet evenly lift the door upward.

The track 14, 114, 314, 414, 514, 614, 714 may be directly or indirectly attached to the structure around the door opening so that the track 14, 114, 314, 414, 514, 614, 714 may be disposed above the door opening and the door that engages the track 14, 114, 314, 414, 514, 614, 714 may be traversed between an opened and closed position. In the closed position, the door is disposed in front of the door opening so that people and things cannot be passed through the door opening. In the opened position, the door is displaced away from the door opening so that people and things can pass through the door opening. It is also contemplated that the track 14, 114, 214, 314, 414, 514, 614 may be embedded within the structure around the door opening so that the track is less noticeable during use. The structure around the door opening may be the wall, header, threshold, floor. In this regard, the door may function as a barn door in front of a door opening.

In the seventh and eighth embodiment shown in FIGS. 26-35, the magnets 618*a, b* and 718*a, b* are inserted into an insert 678*a, b* and 778*a, b.* The inserts 678*a, b* and 778*a, b* are not inserted into the base 680, 780 until the magnets 618*a, b* and 718*a, b* are disposed in the inserts 678, 778. Once the magnets 618*a, b* and 718*a, b* are positioned in the inserts 678, 778, the inserts 678, 778 are inserted into the base 680, 780 of the tracks 614, 714. The inserts 678, 778 may be held in place with an adhesive (e.g., silicon).

The various aspects and embodiments described herein are directed to a magnetic levitation door and illustrated by way of a shower door. However, the various aspects and embodiments of the magnetic levitation door may be incorporated into a sliding screen door, sliding patio door, horizontally sliding window or any other door or opening with a panel that that horizontally slides to open and close the opening.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A door assembly with a door disposable in front of a door opening and traversable between an open position and closed position, the door assembly comprising:

the door being slidable to the open and closed positions, the door defining a length;

two brackets attached to the door, the two brackets being positioned equidistantly on opposed sides of a vertical plane which intersects a center of gravity of the door;

a first magnet attached to each of the first and second brackets, the first magnet having a length less than the length of the door;

a track disposed adjacent to the door opening, the track defining a length about two times the length of the door, the first and second brackets being slidably mounted to the track, the track having opposed inwardly directed fingers;

a second magnet attached to the track, the second magnet having a length greater than a length of the door, the first and second magnets vertically aligned to each other and disposed vertically above stabilizing rollers;

the stabilizing rollers attached to the first and second brackets and disposed within the track, the stabilizing rollers having upper and lower ridges which collectively form grooves that receive the inwardly directed fingers in the grooves for maintaining a vertical position of the door and a vertical gap between the first and second magnets as the door is traversed between the open and closed positions, wherein each stabilizing roller extends horizontally and an axis of rotation of each stabilizing roller extends vertically through the first magnet.

2. The door assembly of claim 1 wherein the length of the second magnet is greater than 80% of the length of the track.

3. The door assembly of claim 1 wherein the first magnet comprises a plurality of magnets disposed on opposed sides of the door so that the door is balanced on the second magnet.

4. The door assembly of claim 1 wherein the second magnet is a single continuous magnet or a plurality of magnets positioned end to end to suspend the door evenly as the door is traversed between the open and closed positions.

5. The door assembly of claim 1 wherein the track is attached to left and right posts which define the door opening.

6. The door assembly of claim 1 wherein a repelling force of the first and second magnets equal a weight of the door.

7. The door assembly of claim 1 wherein a repelling force of the first and second magnets is less than a weight of the door.

8. The door assembly of claim 1 wherein each of the stabilizing rollers define a rotational axes and the first and second magnets intersect the rotational axes of the stabilizing rollers.

9. The door assembly of claim 8 wherein a rotating axis of the stabilizing roller is aligned to a central plane of the door and the track.

10. The door assembly of claim 9 wherein the rotating axis is vertically oriented when the door assembly is assembled in the door opening.

* * * * *